US007013815B2

(12) United States Patent
Levy et al.

(10) Patent No.: US 7,013,815 B2
(45) Date of Patent: Mar. 21, 2006

(54) ADJUSTABLE AIR FOILS FOR BALANCING PULVERIZED COAL FLOW AT A COAL PIPE SPLITTER JUNCTION

(76) Inventors: Edward Kenneth Levy, 1030 Raymond Ave., Bethlehem, PA (US) 18018; Harun Bilirgen, 3998 Autumn Ridge Rd., Bethlehem, PA (US) 18017; Aly Yilmaz, deceased, late of Holden, MA (US); by Ferruhyie Yilmaz, legal representative, 32 Red Barn Rd., Holden, MA (US) 01520

( * ) Notice: Subject to any disclaimer, the term of this patent is extended or adjusted under 35 U.S.C. 154(b) by 81 days.

(21) Appl. No.: 10/936,401

(22) Filed: Sep. 8, 2004

(65) Prior Publication Data

US 2005/0042043 A1 Feb. 24, 2005

Related U.S. Application Data

(63) Continuation-in-part of application No. 10/258,630, filed as application No. PCT/US01/12842 on Apr. 20, 2001, now Pat. No. 6,789,488.

(60) Provisional application No. 60/265,206, filed on Feb. 1, 2001, provisional application No. 60/199,300, filed on Apr. 24, 2000.

(51) Int. Cl.
*F23K 3/02* (2006.01)
*F23K 1/00* (2006.01)

(52) U.S. Cl. ..... 110/309; 110/310; 110/104 R; 110/106

(58) Field of Classification Search ..... 110/347, 110/348, 309, 310, 104 R, 106; 406/155, 406/183

See application file for complete search history.

(56) References Cited

U.S. PATENT DOCUMENTS

| | | | | | |
|---|---|---|---|---|---|
| 2,975,001 | A | * | 3/1961 | Davis | 406/155 |
| 4,094,492 | A | * | 6/1978 | Beeman et al. | 251/212 |
| 4,412,496 | A | * | 11/1983 | Trozzi | 101/347 |
| 4,459,922 | A | * | 7/1984 | Chadshay | 110/265 |
| 4,478,157 | A | * | 10/1984 | Musto | 110/106 |
| 4,570,549 | A | * | 2/1986 | Trozzi | 110/106 |
| 4,779,546 | A | * | 10/1988 | Walsh, Jr. | 110/265 |
| 5,593,131 | A | * | 1/1997 | Briggs et al. | 251/117 |
| 5,685,240 | A | * | 11/1997 | Briggs et al. | 110/106 |
| 5,975,141 | A | * | 11/1999 | Higazy | 138/45 |
| 6,055,914 | A | * | 5/2000 | Wark | 110/104 R |

* cited by examiner

*Primary Examiner*—Kenneth Rinehart
(74) *Attorney, Agent, or Firm*—Law Offices of Royal W. Craig

(57) ABSTRACT

An adjustable device installed at the inlet of conventional junctions/splitters (116) for on-line control of the distribution of coal among the outlet pipes is herein disclosed. The device includes a plurality of wake inducing airfoils (60) each positioned upstream of a plurality of flow channels in the riffler (50) for directing coal flow to the outlet pipes. Each wake-inducing airfoil has a cross-section defined by a width W that varies along its length H for creating upstream turbulence, and a particle wake that preferentially diverts the coal flow to one of the outlet pipes at the splitter junction without affecting primary air flow. For example, each wake inducing airfoil may comprise a rounded convex edge leading to straight tapered sides. The surfaces of the sides may be roughened or textured (63) for promoting turbulent boundary layers. In addition, conventional fixed or variable orifices may be used in combination with the wake inducing airfoils for balancing primary air flow rates. The device allows fine-adjustment control of coal flow rates when used in combination with the slotted riffler, yet it has negligible effect on the distribution of primary air, resulting in closely balanced coal flow, reduced pollutant emissions and improved combustion efficiency.

6 Claims, 26 Drawing Sheets

| Case | Air Imbalance (%) | | Coal Imbalance (%) | |
|---|---|---|---|---|
| | Left | Right | Left | Right |
| Unbalanced Air | -22.0 | +22.0 | +9.45 | -9.45 |
| Balanced Air | -1.2 | +1.2 | +18.4 | -18.4 |

For a riffler passage width of PW:

0.0 PW < R < 2.0 PW
0.0 PW < W < 2.0 PW
0.0 PW < H < 2.0 PW
0.0 degree < a < 90 degrees Flow Balancing Tests (Cases From 2 to 6 in Figure 11)

ADJUSTABLE AIR FOILS FOR BALANCING PULVERIZED COAL FLOW AT A COAL PIPE SPLITTER JUNCTION

CROSS-REFERENCE TO RELATED APPLICATIONS

The present application is a continuation-in-part of U.S. patent application Ser. No. 10/258,630, filed Oct. 24, 2002, now U.S. Pat. No. 6,789,488 which is from International PCT Application PCT/US01/12842 filed Apr. 20, 2001, corresponding to U.S. patent applications Ser. No. 60/199,300, filed 24 Apr. 2000 and Ser. No. 60/265,206, filed: 1 Feb. 2001.

BACKGROUND OF THE INVENTION

1. Field of the Invention

The present invention relates to pulverized coal boilers and, more particularly, to adjustable air foils for balancing pulverized coal flow therein.

2. Description of the Background

In a typical large pulverized coal boiler, coal particulate and primary air flow from the pulverizers to the burners through a network of fuel lines that are referred to as coal pipes.

FIG. 1 illustrates a typical large pulverized coal boiler inclusive of pulverizer(s) 10, furnace 30, and network of coal pipes 20. For proper operation of the boiler, all the coal pipes 20 connected to any one of the pulverizers 10 should carry the same coal flow rates and the same flow rates of primary air.

Unfortunately, differences in coal and primary air flow rates from one coal pipe 20 to the next are a limiting factor in the ability to reduce $NO_x$ emissions in pulverized coal boilers. High carbon monoxide emissions and high levels of unburned carbon can result from burner imbalances. High fly ash unburned carbon, in turn, can adversely affect electrostatic precipitator collection efficiency and result in elevated stack particulate emission levels. Imbalances in coal pipe flows can also lead to maintenance problems associated with coal pipe erosion and/or clogging (e.g. excessive localized coal accumulation), damage to burners and windboxes, and accelerated waterwall wastage. Problems such as these reduce the operating flexibility of the boiler and often require that the boiler be operated under conditions which produce higher $NO_x$ levels than would otherwise be achieved.

Often, due to the configuration of the boiler system, the flow from a single coal pipe must be split into two or more flows. FIG. 4 shows an example of a four-way splitter arrangement 100 that is sometimes encountered in pulverized coal boiler systems. The arrangement 100 involves coal and primary air flow from a single pipe 102 dividing into four flows at a four-way splitter 104. Industry experience shows that the coal flow rates among the four outlet pipes 106*a–d* can be severely imbalanced. This is because the distribution of coal flow rates among the pipes 106*a–d* strongly depends on the pulverized coal flow distribution at the inlet cross-section of the four-way splitter 104, and a significant pulverized coal flow non-uniformity exists due to an upstream elbow 110. The non-uniformity causes the coal particles to stratify into a narrow localized stream (i.e. rope flow) close to the outer wall of the elbow 110. For this reason, a flow splitter must be installed either sufficiently far from an elbow or be designed to accommodate significant coal flow non-uniformity. However, due to the space limitations associated with many applications/installations, a flow splitter has to be installed immediately after an elbow where, as stated above, the coal particulate exists as a narrow, localized rope flow.

The distribution of primary air throughout the coal piping network is controlled by the flow resistances of the various coal pipes 20. Because of differences in pipe lengths and numbers and types of elbows in each fuel line, the different coal pipes from a pulverizer will usually have different flow resistances. It is known that orifices or flow restrictors can be installed within the pipes 20 for use in adjusting the individual primary air flows to make them equal.

For example, U.S. Pat. No. 5,593,131 to O. Briggs and J. Sund shows a Variable Orifice Plate for Coal Pipes for balancing coal pipe flows.

U.S. Pat. No. 5,685,240 to O. Briggs and J. Sund shows a Variable Orifice Plate for Coal Pipes.

U.S. Pat. No. 4,094,492 to R. Beeman and S. Brajkovich shows a Variable Orifice Using an Iris Shutter.

U.S. Pat. No. 4,779,546 to W. Walsh shows a Fuel Line Orifice.

U.S. Pat. No. 5,975,141 to M. Higazy shows an On-Line Variable Orifice.

U.S. Pat. No. 4,459,922 to R. Chadshay shows an Externally Adjustable Pipe Orifice Assembly.

U.S. Pat. No. 6,055,914 to Wark is a pre-riffler mixing device for balancing out the coal and air flows upstream of a riffler box to ensure a more homogenous flow. This is accomplished with concentric mixing rings that interrupt both coal and air flows to create turbulence, thereby mixing the flows. The Wark '914 device restricts the combined coal and air flows, and does not teach or suggest controlling the direction of coal flow distribution into a plurality of outlet pipes without substantially interrupting air flow.

FIG. 5 shows a sub-section of a known existing installation where a Venturi 112 was installed between the exit of the elbow 114 and the inlet of the four-way splitter 116 in an attempt to lower inherent coal flow imbalances. Laboratory testing with this configuration showed a ±35% coal flow imbalance among the four outlet pipes 118.

It can be seen in the above-cited references that orifices with both fixed geometry and adjustable geometry are available commercially.

While the use of fixed or adjustable orifices can be an effective way of balancing primary air flow rates, evidence from field and laboratory measurements indicates the orifices have little effect on coal flow rates. Instead, the coal flow distribution among the pipes is affected most strongly by flow conditions and geometry in the inlet regions of the pipes.

FIG. 2 illustrates a coal pipe 20 according to one piping arrangement commonly encountered in pulverized coal boiler systems. This arrangement involves coal and primary air flow from one pipe 20 dividing into two flows at a Y-shaped junction/splitter. Industry-wide experience shows the coal flow rates among the two outlet pipes 22, 23 can be severely imbalanced. More specifically, conventional orifices 40*a–b* are installed to prevent primary air flow imbalance and the underlying table shows the results from a series of laboratory tests carried out on the effectiveness of orifices 40*a–b*. As the data show, selection of the proper orifices 40*a–b* as required to balance the primary air flow rates did not simultaneously result in a balanced coal flow distribution. In fact, in this case, the orifices 40*a–b* increased the coal flow imbalance from 9.45% to 18.4%.

A second alternative comprises the insertion of a slotted riffler in a splitter box as shown in FIG. 3 (prior art). The slotted riffler configuration is also commercially used to reduce fuel flow imbalances. The slotted riffler concept consists of a series of flow channels with rectangular cross sections, each of which directs a portion of the coal and primary air flow to one of the outlet pipes. Field measurements show that while these types of rifflers can help to reduce coal flow imbalance arising from a mal-distribution of coal flow at the inlet, they generally do not eliminate the imbalance. Additional fine control of the coal flow distribution is still needed.

A third attempted solution for the coal flow imbalance is the use of adjustable baffles to modify the coal flow distribution among the outlet pipes 22, 23. The following references describe the use of baffles to modify coal flow distribution.

U.S. Pat. No. 4,570,549 to N. Trozzi shows a Splitter for Use with a Coal-Fired Furnace Utilizing a Low Load Burner.

U.S. Pat. No. 4,478,157 to R. Musto shows a Mill Recirculation System.

U.S. Pat. No. 4,412,496 to N. Trozzi shows a Combustion System and Method for a Coal-Fired Furnace Utilizing a Low Load Coal Burner.

Finally, U.S. Pat. No. 2,975,001 issued on Mar. 14, 1961 to Davis discloses an apparatus for dividing a main stream of pulverized coal between two branch streams. (Col. 1, lines 50–52). The apparatus may be used alone or in conjunction with a conventional slotted riffle. (Col. 1, lines 70–73). The apparatus is comprised of a combination fixed and tiltable nozzle. (Col. 1, lines 50–58). The fixed nozzle is attached to the main duct leaving the pulverizer and concentrates the coal and air flow. (Claims 1–5). The concentrated coal and air flow is then directed into the tiltable nozzle with the highest concentration of coal necessarily being at the nozzle centerline. The tiltable nozzle is then "tilted" in order to direct the concentrated coal and air flow into one or the other branch stream. (Claims 1–5).

Guide vanes may be mounted inside the tiltable nozzle; however, this patent does not disclose adjustable guide vanes. (Col. 1, lines 58–60).

All of the foregoing references teach a form of direct diversion of both the coal and air flow. It is impossible using direct diversion to increase or decrease the flow of coal into a particular outlet pipe without effecting primary air flow, or vice versa.

According to Schlichting's Boundary Layer Theory, McGraw Hill, 7th ed, 1979, a wake is formed behind a solid body which has been placed in a stream of fluid. The axial velocities in a wake are smaller than those in the main stream. As the downstream distance from the body is increased, the differences between the velocity in the wake and that outside the wake become smaller. The present inventors specifically avoid direct jet diversion of the entire flow stream as described in Davis '001, and instead use airfoils to form wakes to indirectly divert the coal flow without affecting primary air flow. The difference is significant because the gas and particle flow in the wake region, a short distance downstream, has the lowest particle concentrations and velocities and air velocities at the centerline behind the object. Used with a riffler as described above, this makes it possible to increase or decrease the flow in one of the outlet pipes by moving the wake-inducing foils in a direction perpendicular to the flow. The unique approach makes it possible to increase or decrease the flow of coal into a particular outlet pipe without effecting primary air flow. In contrast, it is very difficult with an adjustable baffle approach to simultaneously balance coal and primary air flow rates.

It would, therefore, be advantageous to provide splitter designs that eliminate coal flow imbalances at crucial points in a pulverized coal boiler system using an on-line adjustment capability that does not disturb any pre-existing primary air flow balance among the multiple coal pipes. This would permit the operation of the pulverized coal boiler system to be optimized and result in reduced pollutant emissions and improved combustion efficiency.

SUMMARY OF THE INVENTION

It is, therefore, the main object of the present invention to provide an improved method and apparatus for the on-line balancing of multiple coal flows in a pulverized coal boiler system using a slotted riffler configuration, thereby making it possible to operate the boiler system with reduced pollutant levels (e.g. $NO_x$, CO) and increased combustion efficiencies.

It is another object of the present invention to provide an improved method and apparatus for the on-line balancing of multiple coal flows in a pulverized coal boiler system that does not disturb any pre-existing primary air flow balance among the multiple coal pipes.

It is a further object of the present invention to provide an improved method and apparatus for the on-line balancing of multiple coal flows in a pulverized coal boiler system at any of a two-way, three-way, and four-way splitter respectively having four outlet pipes.

It is a further object of the present invention to provide an improved method and apparatus for the on-line balancing of multiple coal flows in a pulverized coal boiler system that can be readily installed within the piping networks of existing pulverized coal power plants.

The above objects will become more readily apparent on an examination of the following description and figures. In general, the present invention disclosed herein includes a new method and apparatus for coal flow control at junctions/splitters common to some pulverized coal transfer systems at coal-fired power plants.

The present invention includes riffler assemblies designed to lower coal flow imbalance (i.e. restore uniform particulate flow distribution). Furthermore, the present invention includes flow control elements (e.g. a plurality of wake-inducing airfoils) located just upstream of the riffler assembly to provide means for on-line coal flow adjustment/control. The present invention does not use direct diversion of the entire flow stream as described in Davis '001. Rather, it uses adjustable wake-inducing airfoils in the coal/air flow path to create air and particle wakes downstream of the obstacles. The air flow in the wake region behind the centerline of the airfoils has the lowest coal particle concentrations and velocities. Adjusting these wake-inducing airfoils relative to the flow channels of a slotted plate riffler makes it possible to increase or decrease the flow of coal into a particular outlet pipe without effecting primary air flow. Each wake-inducing airfoil has a cross-section defined by a width W that varies along its length H for creating upstream turbulence, and a particle wake that preferentially diverts the coal flow to one of the outlet pipes at the splitter junction without affecting primary air flow. Varying the width W along the height H results in a non-constant "Airfoil Thickness", which is defined as the width of the airfoil profile. Thus, the wake-inducing airfoils of the present invention have a defined "aerodynamic center" corresponding to the point of maximum width, which induces an airflow that is accelerated over the airfoil and therefore produces a wake. The angle of attack can be varied to increase or decrease the pressure differential induced by the airfoil. With this in mind, the wake-inducing airfoils cannot have a constant Airfoil Thickness (like a flat vane) but may otherwise have a variety of suitable cross-sectional shapes in which width W varies along their length H to induce a wake. Suitable cross-sections include shapes from among the group consisting of teardrop, diamond, oval, triangle, circle, pentagon or others, so long as the cross-section from leading edge to back defines a non-constant Airfoil Thickness and is not simply a flat diverter vane. In each case the side surfaces may be roughened or textured to promote turbulent boundary layers. The combination of the riffler assembly and the wake-inducing airfoils make it possible to achieve on-line control of the flow distribution, and result in closely balanced coal flow in the outlet pipes.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENT

As described above, the distribution of primary air in most coal boilers must be controlled separately by use of orifice-type restrictions in individual pipes. It is important for good combustion that the mechanism for controlling the coal flow distribution have negligible effect on the distribution of primary air. The present invention offers a solution in the form of adjustable wake-inducing airfoils installed at the inlet of a slotted riffler, for on-line control of the distribution of coal among the outlet pipes. The wake-inducing airfoils create primary air and particle wakes, and the distribution of pulverized coal and primary air to the coal boiler can be manipulated by controlling the location, size and characteristics of the wakes via the wake-inducing airfoils.

Figure 1:
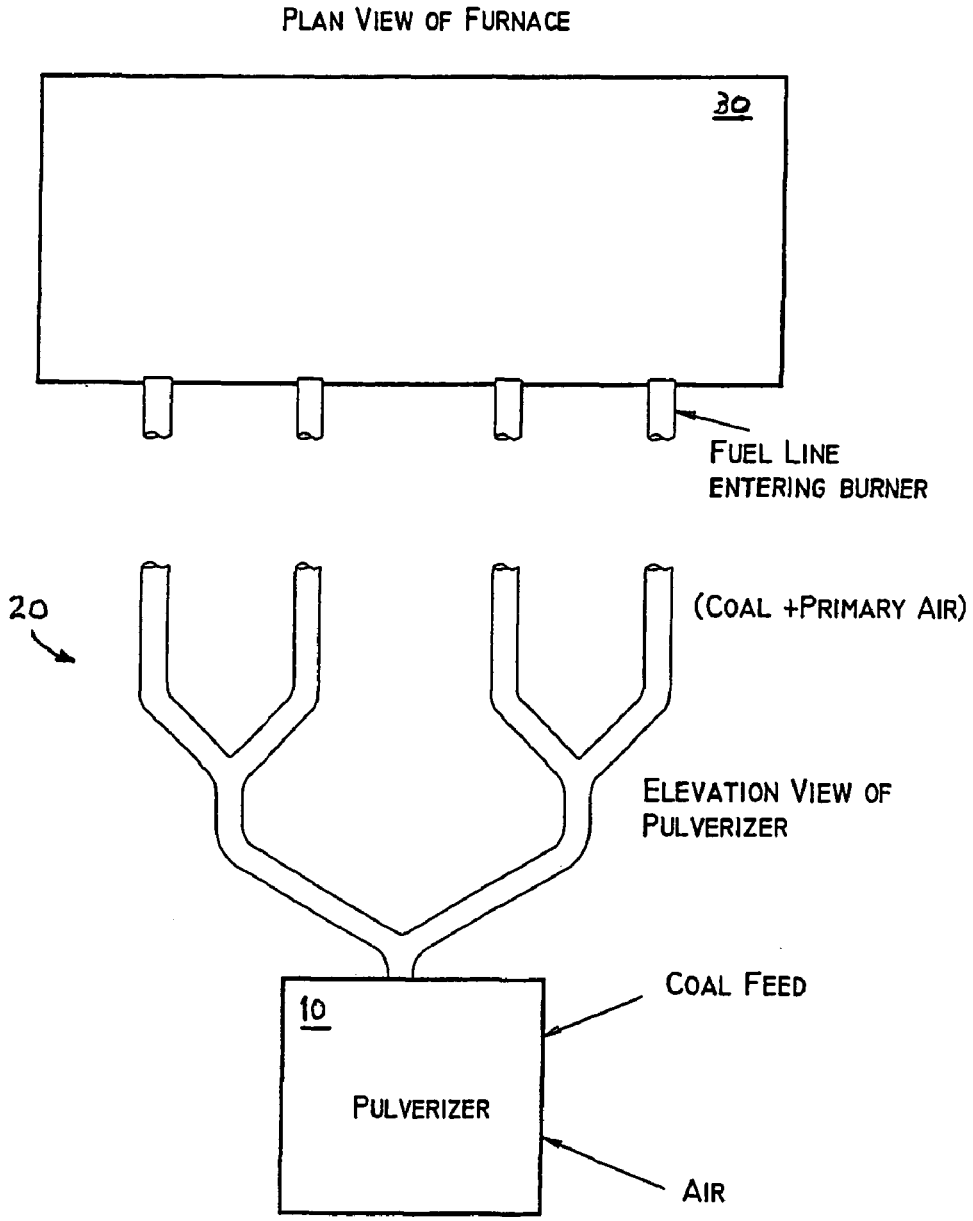
FIG. 1 illustrates a typical large pulverized coal boiler inclusive of pulverizer(s) 10, furnace 30, and network of coal pipes 20.
Figure 2:
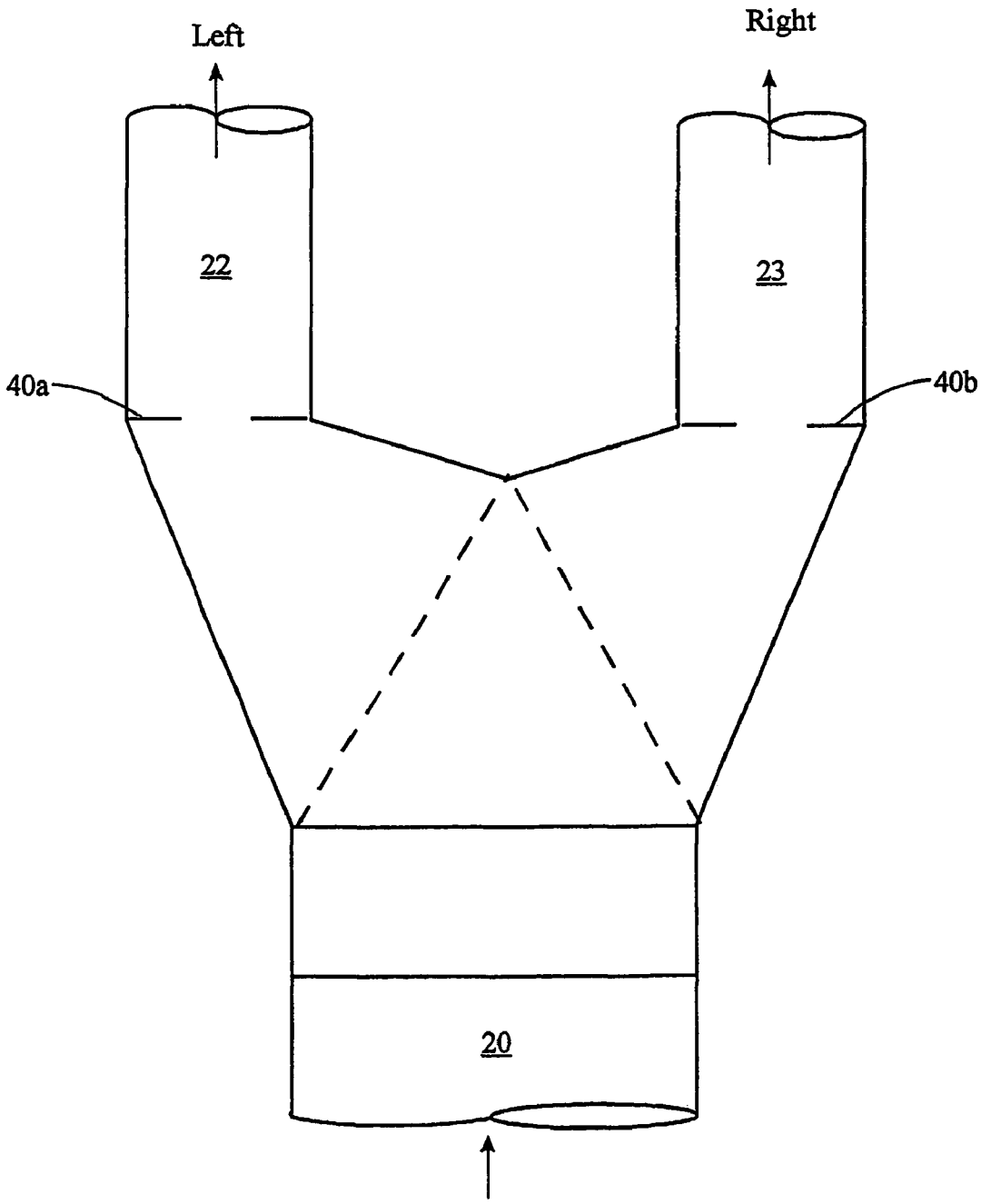
FIG. 2 illustrates a coal pipe 20 according to one typical piping arrangement commonly encountered in pulverized coal boilers.
Figure 3:
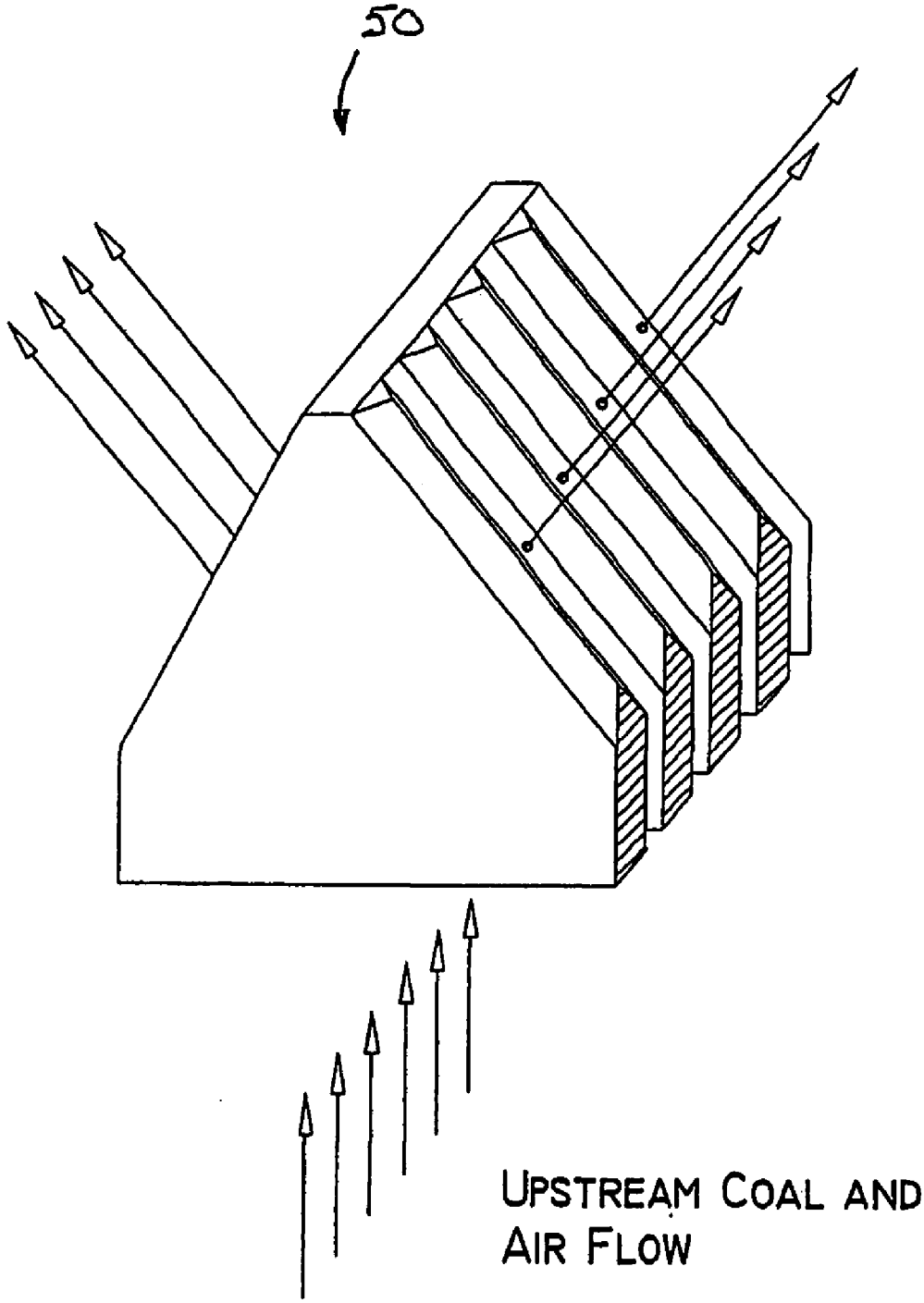
FIG. 3 (Prior Art)
FIG. 3 illustrates a prior art slotted riffler in a splitter box.
Figure 4:
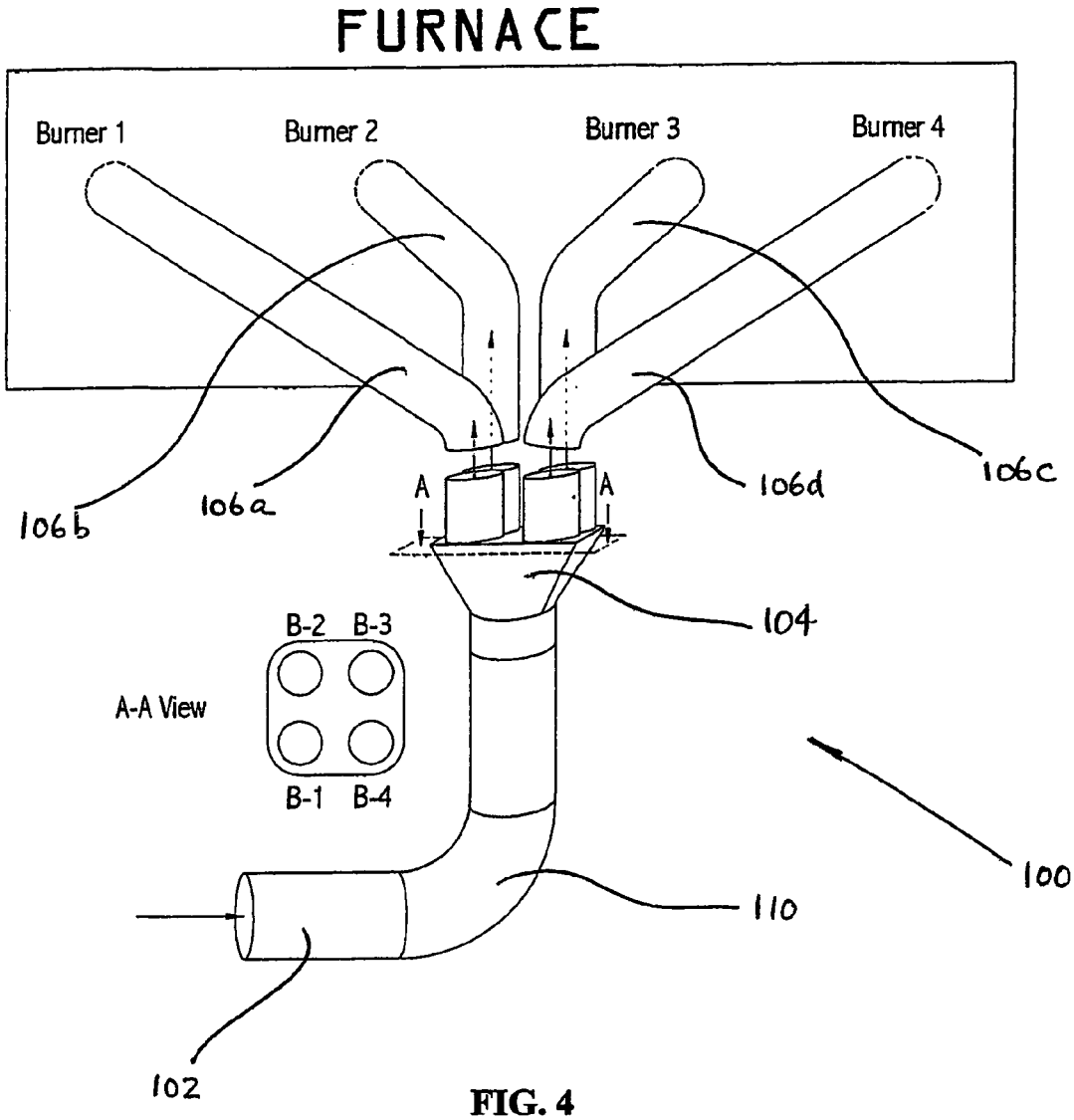
FIG. 4 illustrates a multi-pipe arrangement 100 that is sometimes encountered in pulverized coal boiler systems.
Figure 6:
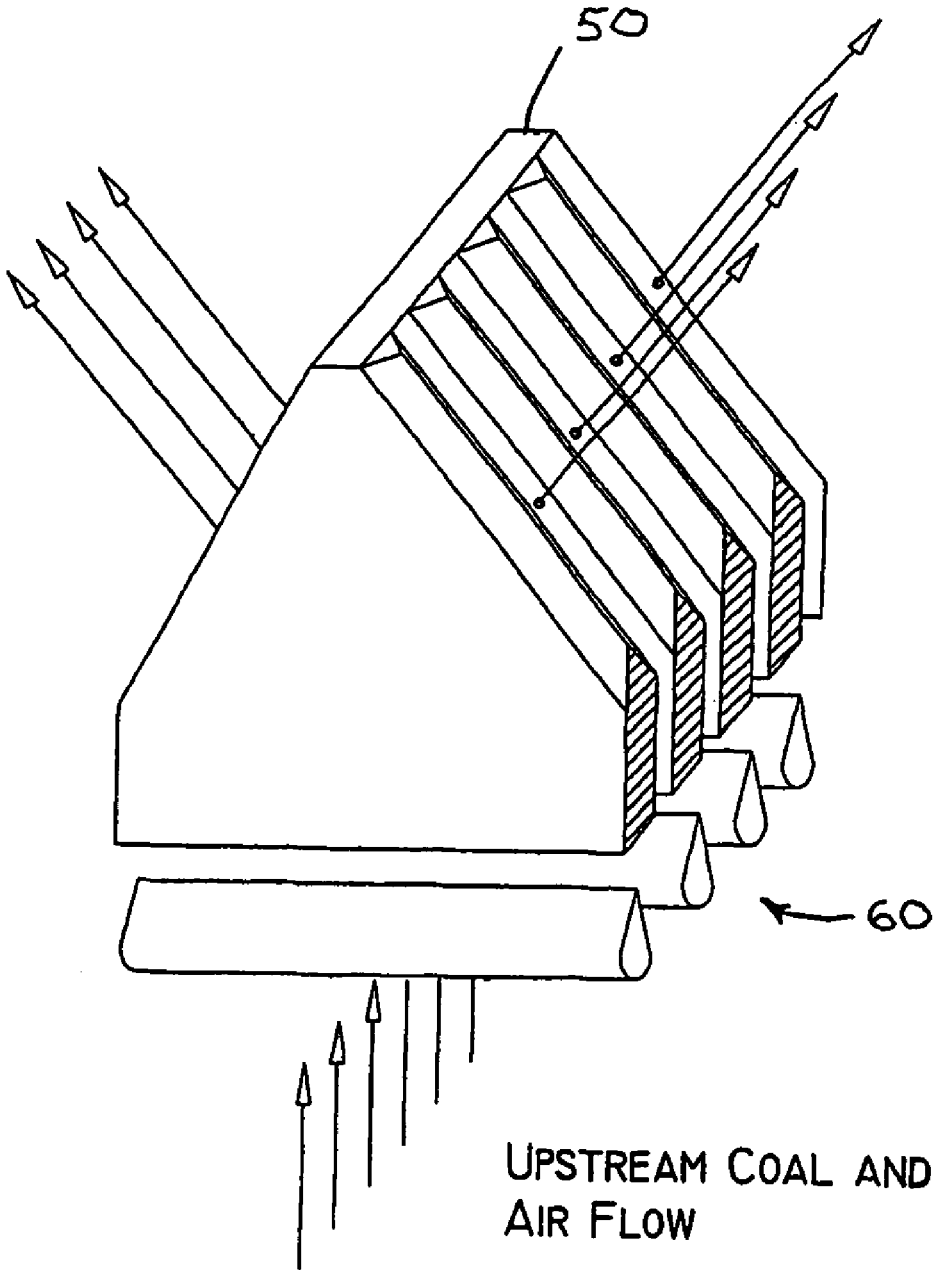
FIG. 6 shows an array of long wake-inducing airfoils 60, according to a first embodiment of the present invention, that are placed just upstream of the inlet to a conventional riffler 50.

More specifically, and as shown in FIG. 6, one embodiment of the present invention consists of an array of long air foil-like wake-inducing objects 60 that are placed just upstream of the inlet to a conventional riffler 50. As described above, a conventional riffler 50 (see FIG. 3) when used in a two-way splitter (see FIG. 2) directs the flow of primary air to either the left or right outlet pipe by alternate riffler flow channels. When wake-inducing airfoils 60 are placed upstream of riffler 50 and directly in-line with the internal walls of the riffler 50, the elements 60 have no effect on the coal flow distribution through the riffler 50. However, lateral movement of wake-inducing airfoils 60 causes a shift in the coal flow distribution through the riffler 50.

Figure 7:
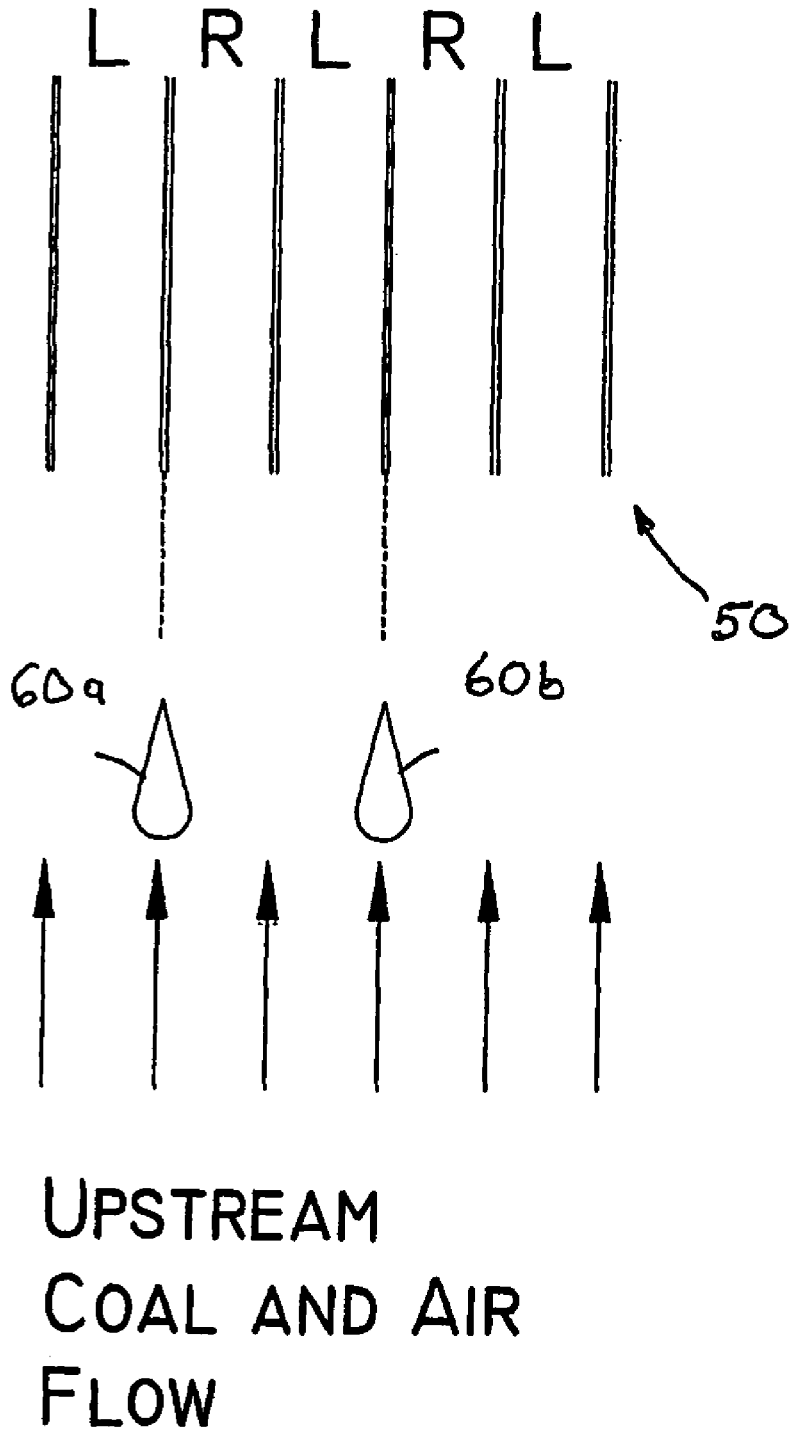
FIG. 7 illustrates the discrete riffler 50 channels (indicated left "L" and right "R") with a pair of upstream wake-inducing foils 60*a* and 60*b* according to a first embodiment of the present invention.

FIG. 7 illustrates the discrete riffler 50 channels (indicated as left "L" and right "R") with a pair of upstream wake-inducing airfoils 60*a* and 60*b* positioned in-line with the internal walls of the riffler 50. When the wake-inducing airfoils 60*a* and 60*b* are moved sideways, either to the right or left, they cause a shift in the coal flow distribution through the riffler 50.

Figure 8:
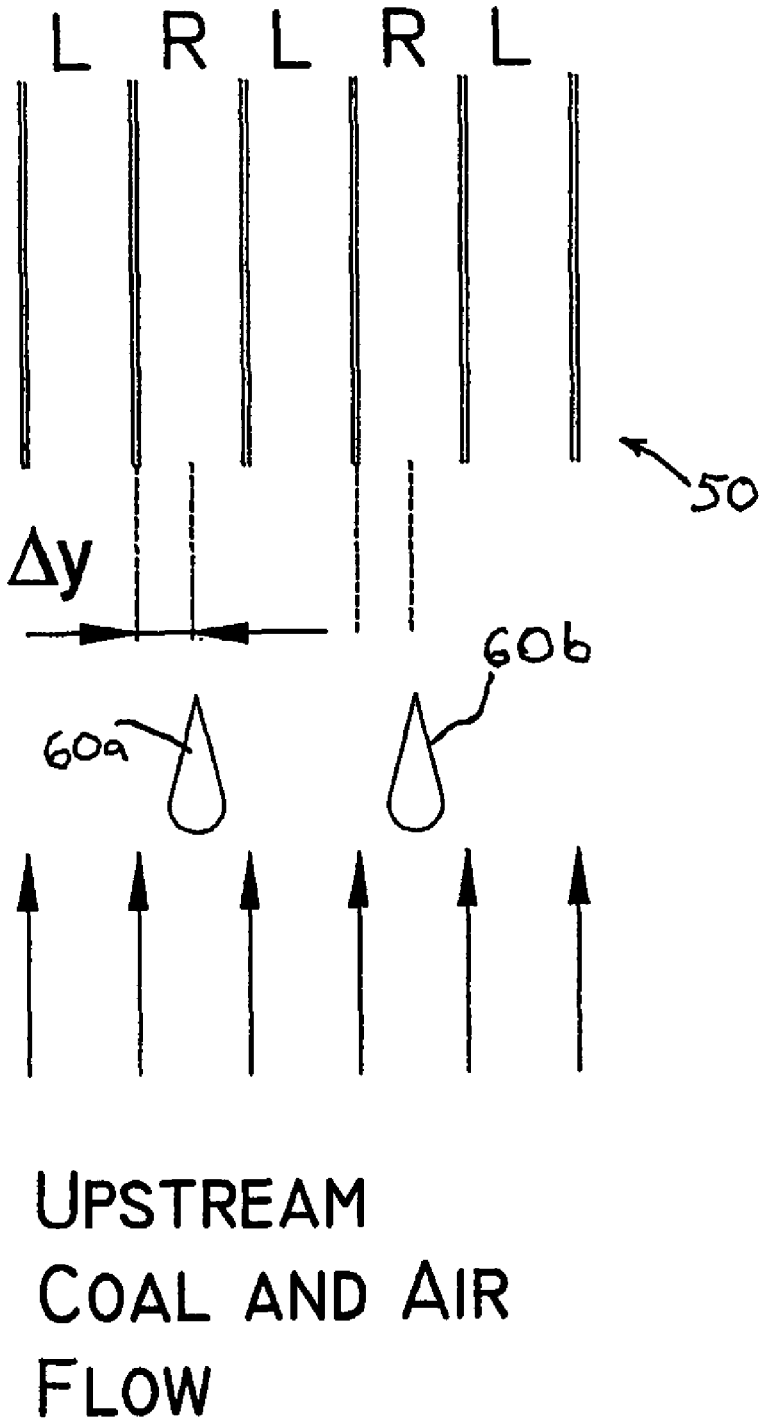
FIG. 8 illustrates the transverse displacement of wake-inducing foils 60*a* and 60*b* to increase coal flow to the left side of the riffler 50.

More specifically, FIG. 8 illustrates the selective right-displacement of wake-inducing airfoils 60*a* and 60*b* to increase coal flow to the left side of the riffler 50. Increasing amounts of displacement Δy will cause an increase in coal flow to the left outlet pipe L and a corresponding decrease in coal flow to the right outlet pipe R.

An entire array of parallel flow-control elements 60 can be adjustably mounted on positioning rods (not shown) supported by bushings in the outer walls of the piping system. This way, the selective transverse position Δy of all parallel flow-control elements 60 can be simultaneously adjusted from outside the pipe by sliding the positioning rods, in or out of the pipe, thereby permitting on-line control of the coal flow distribution.

The individual wake-inducing airfoils 60 preferably employ a particular shape to ensure that the control of coal flow distribution does not affect the primary air flow distribution. For best performance, each element 60 preferably has a tear-drop shape similar to that shown in FIG. 9. The breadth b of the upstream surface of element 60 is convex, with a circular or nearly-circular profile. The straight sides of the element are tapered along their length at an angle αto an apex. The primary air flow creates boundary layers on the surfaces of the element 60, thereby producing a wake region downstream. All of the physical dimensions of the wake-inducing airfoil 60 combine to affect the nature of the wake.

Figure 9:
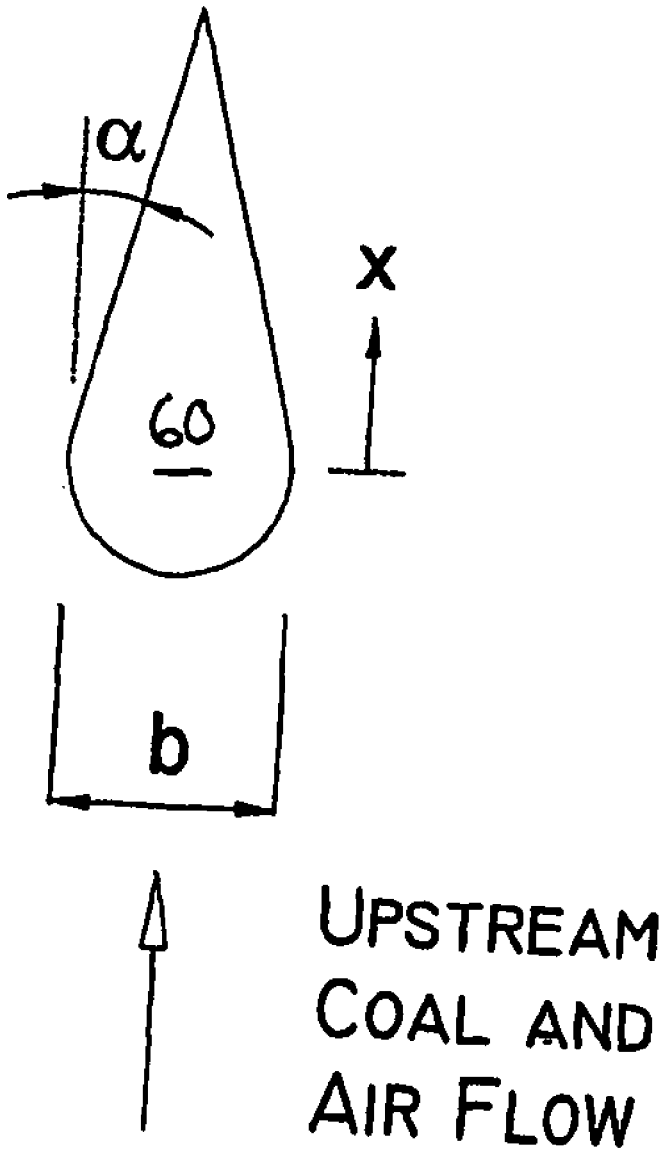
FIG. 9 is a cross-section of the preferred shape of a single wake-inducing foil 60 according to a first embodiment of the present invention.
Figure 10:
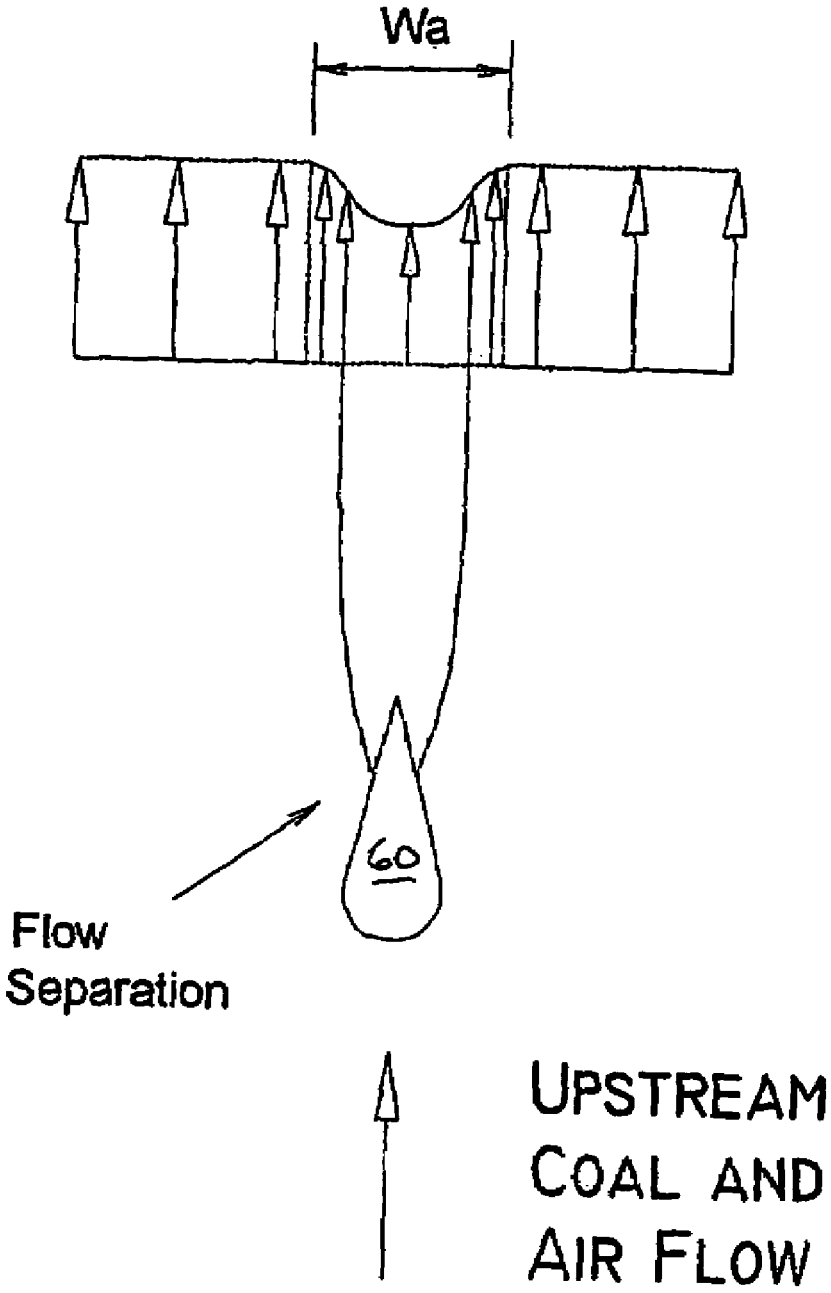
FIG. 10 illustrates the width of the wake in the primary air flow downstream of wake-inducing foil 60.

FIG. 10 illustrates the width of the wake in primary air flow downstream of element 60. With combined reference to FIGS. 9 and 10, the dimensions of the element 60 and magnitude of the average primary air velocity in the coal pipe result in laminar boundary layers on the sidewalls of the element 60. Laminar boundary layers are particularly susceptible to boundary layer separation for a sufficiently large angle α. Delaying the onset of separation to positions further downstream (larger x) reduces the width of the wake region (Wa) for the primary air flow. This reduces the effect of changes in position of the control element 60 on primary air flow distribution through the riffler 50.

Figure 11:
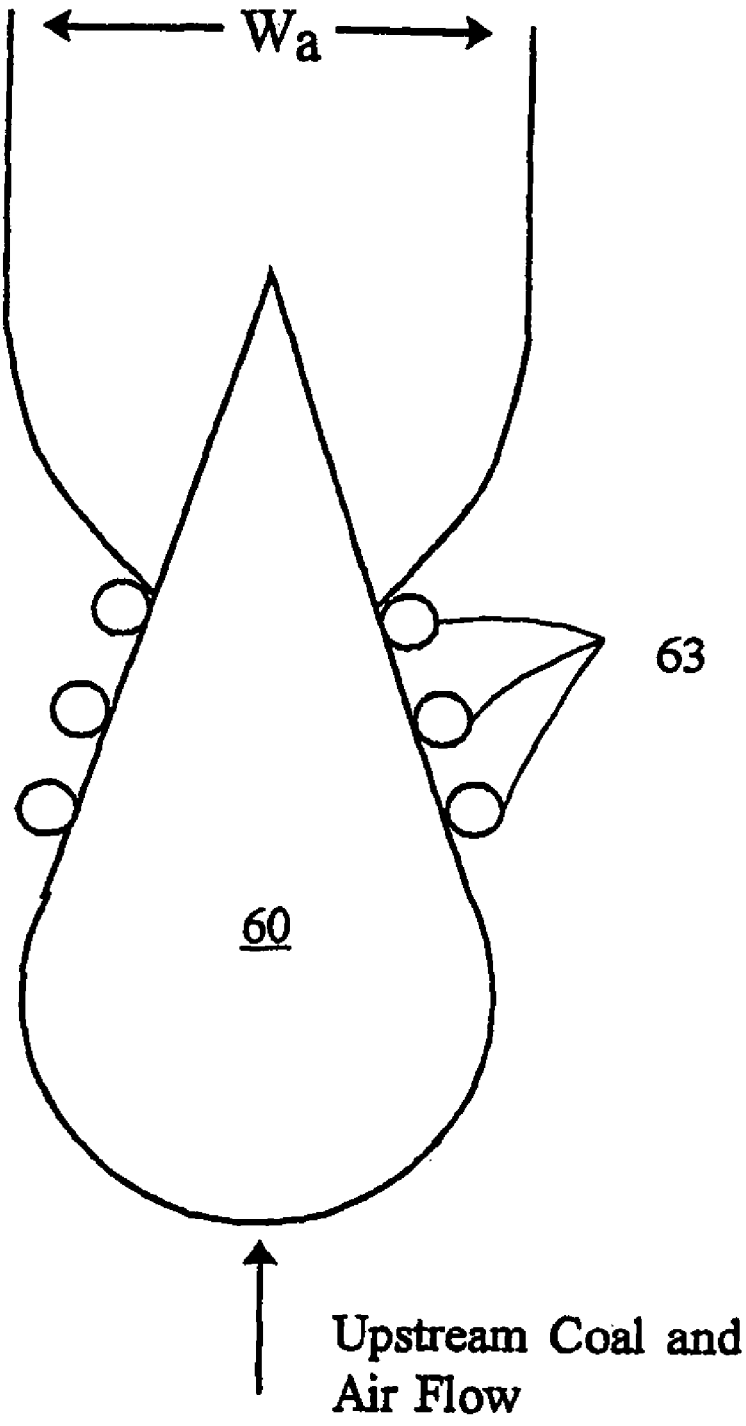
FIG. 11 shows the addition of roughness elements 63 for further reducing the width of the primary air wake (Wa).

The further addition of surface roughness on the tapered side surfaces of the elements 60 can trigger transition to turbulence. This moves the flow separation even further downstream and reduces the width of the primary air wake (Wa) even more FIG. 11 shows the addition of roughness elements 63 for further reducing the width of the primary air wake (Wa). Roughness elements 63 may be any suitable sputter-coating on wake-inducing foil 60, or machined ribs, grooves or the like. The roughness elements and/or other surface textures reduce the width of the primary air wake (Wa) by delaying flow separation.

Figure 12:
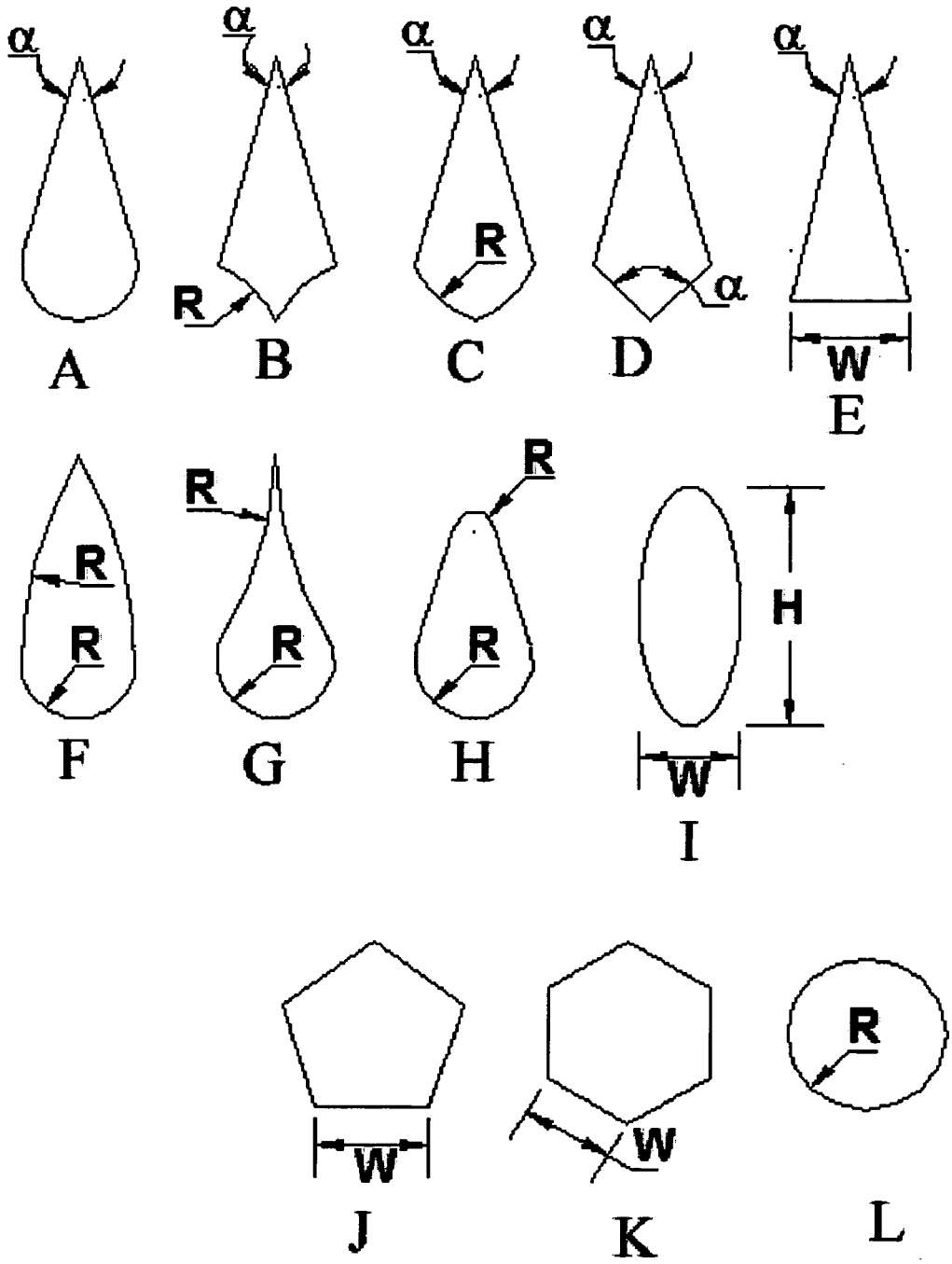
FIG. 12 illustrates examples of alternative wake-inducing foil shapes, each of which creates primary air and particle wakes having certain widths and other characteristics.

It should be understood that wake-inducing airfoil shapes other than as indicated in FIGS. 6–11, and other element surface contours/textures can be used, depending on the application. The goal is the creation and control of a wake region. Other shapes create wakes having different sizes and characteristics. Each wake-inducing airfoil must have a cross-section defined by a width W that varies along its length H for creating upstream turbulence, and a particle wake that preferentially diverts the coal flow to one of the outlet pipes at the splitter junction without affecting primary air flow. Varying the width W along the height H results in a non-constant "Airfoil Thickness", which is defined as the width of the airfoil profile. Thus, the wake-inducing foils of the present invention have a defined "aerodynamic center" corresponding to the point of maximum width, which induces an airflow that is accelerated over the airfoil and therefore produces a wake. Conversely, the wake-inducing airfoils cannot have a constant Airfoil Thickness (like a flat vane) but may otherwise have a variety of suitable cross-sectional shapes in which width W varies along their length H to induce a wake. Suitable cross-sections include shapes from among the group consisting of teardrop, diamond, oval, triangle, circle, pentagon or others, so long as the cross-section from leading edge to back defines a non-constant Airfoil Thickness and is not simply a flat diverter vane. For example, FIG. 12 illustrates twelve examples A–M of alternative wake-inducing airfoil shapes, which may be any from among the group consisting of teardrop (see A, F, G, H), diamond (D), modified diamond (B, C), oval (I), triangle (E), circle (L), pentagon (J), hexagon (K). Any geometry including polygons with non-constant cross-section as described above is considered to be acceptable. Each of the alternative shapes of FIG. 12 create primary air and particle wakes having certain widths and other characteristics.

Figure 13:
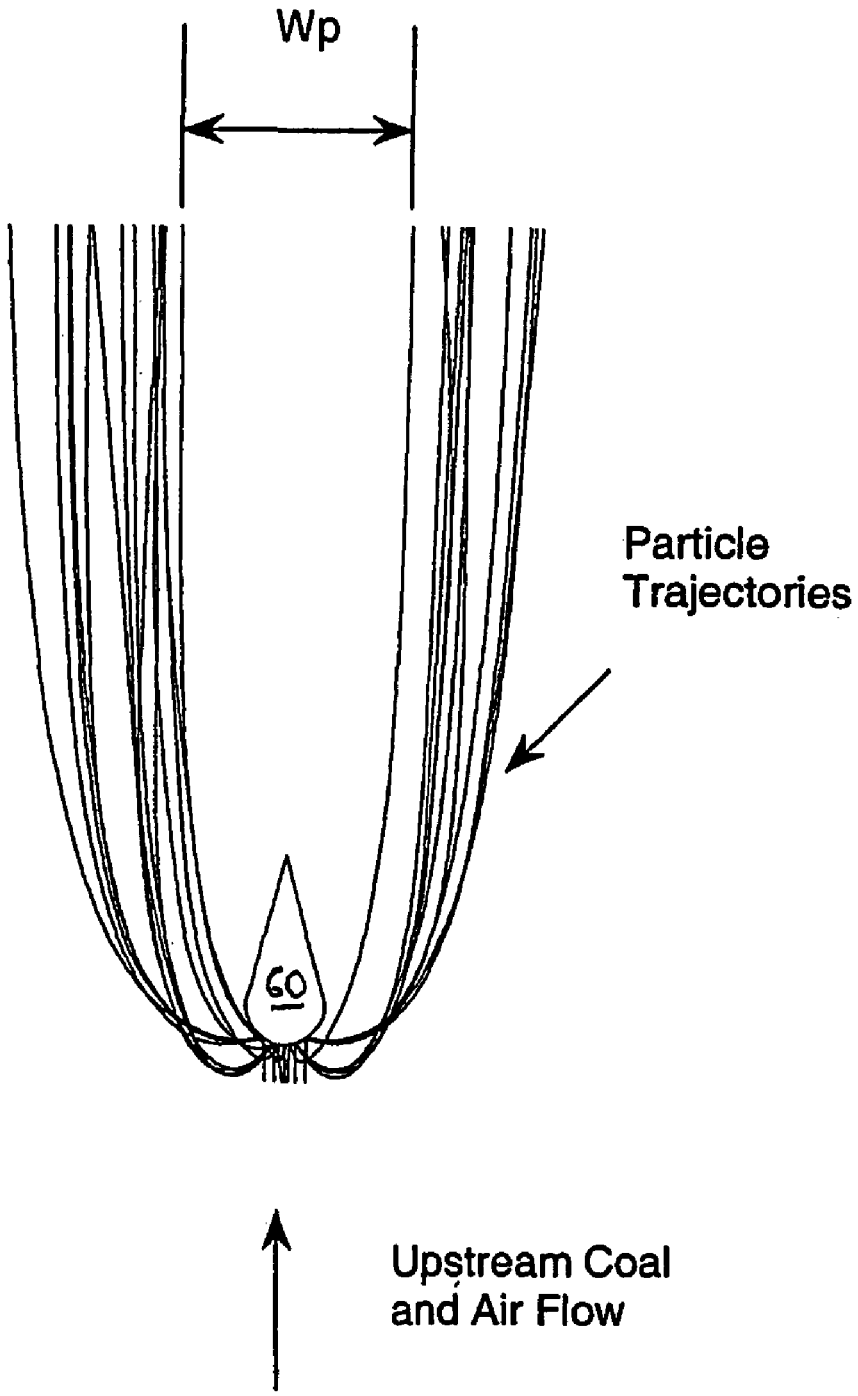
FIG. 13 is a plot of the particle trajectories downstream of wake-inducing foil 60.

FIG. 13 is a plot of the coal particle trajectories downstream of wake-inducing airfoil 60. As seen in FIG. 13, the width of the particle wake (Wp) is controlled by the particle size distribution, the velocity of upstream flow, the width b (as in FIG. 9) of element 60, and the shape of the upstream surface of the element 60. The rounded, convex shape of wake-inducing foil 60 is presently preferred because it provides a smooth match with the straight tapered side walls of the coal pipe 20. The width b of element 60 is limited by the widths of the flow channels in riffler 50. For the typical particle sizes and flow velocities which occur in coal pipes in pulverized coal boilers, the width of the particle wake is larger in magnitude than the width b of element 60 as shown in FIG. 9.

Figure 14:
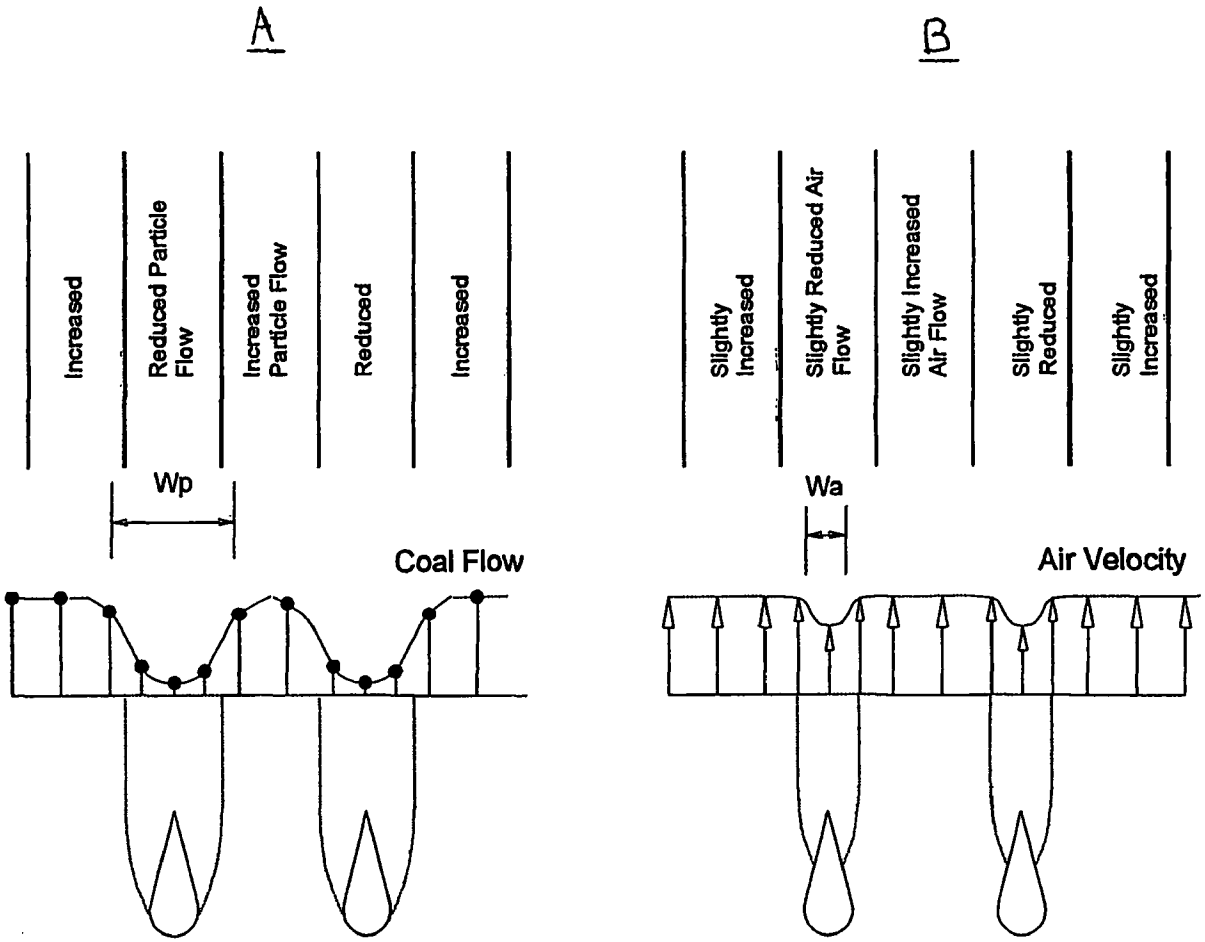
FIG. 14 is a graphical illustration of the particle concentration wake (A) and primary air flow wake (B) which result from the above-referenced wake-inducing airfoil 60 design.

FIG. 14 is a graphical illustration of the particle concentration wake (A) and primary air flow wake (B) which result from the above-referenced wake-inducing airfoil 60 design. It can be seen that the particle wake causes a bell-curve reduction in particle flow across a width Wp that exceeds the width b of the wake-inducing foil 60. On the other hand, the primary air flow wake causes only a minor interruption in primary air flow across a width Wa that is smaller than the width b of the wake-inducing foil 60. Thus, the elements 60 have a negligible effect on the distribution of primary air and this eliminates the need for separate control of orifice-type restrictions in individual pipes.

Laboratory tests have been conducted which demonstrate the effectiveness of the above-described invention in controlling coal flow distribution, without affecting primary air flow distribution. These tests were carried out with a 6" inlet pipe and two 4" outlet pipes. The inlet air velocity was 100 feet per second (fps) and the ratio of the mass flow rate of pulverized coal to the mass flow rate of air was 0.7.

Figure 15:
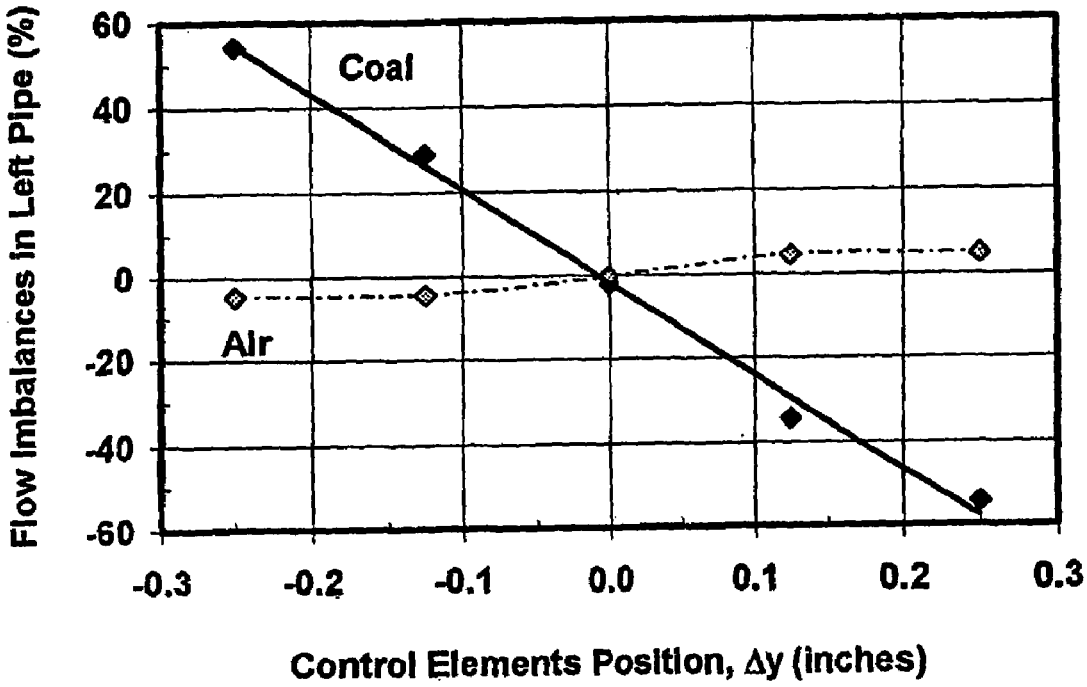
FIG. 15 is a plot showing the effect of the lateral position y of the wake-inducing airfoils 60 on the coal and primary air flow imbalances.

FIG. 15 is a plot of test results showing the effect of the lateral position Δy of the wake-inducing airfoils 60 on the coal and primary air flow imbalances. The data show small adjustments in wake-inducing airfoil position Δy resulted in large changes in coal flow distribution, but almost no change in primary air flow distribution.

Other common configurations found in coal boiler systems split the flow of coal/primary air from one inlet pipe into three or four outlet pipes by use of a riffler assembly. The same above-described approach of adjustable air foil elements if used in combination with a slotted riffler can be applied in these cases to control the distribution of coal flow among the outlet pipes.

Figure 16:
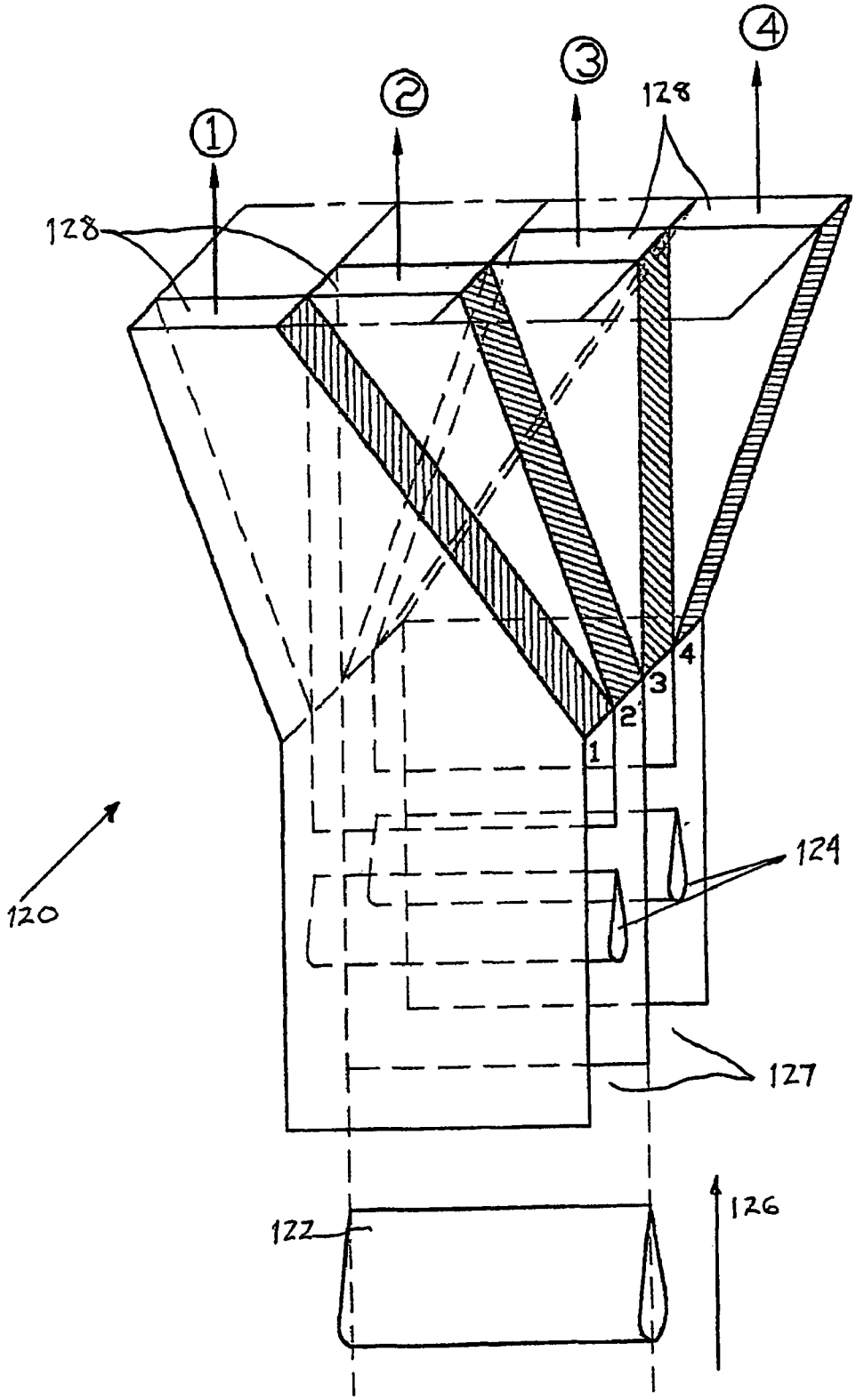
FIG. 16 shows a single four-way riffler element assembly 120 according to an alternative embodiment of the present invention.

FIG. 16 shows a single four-way riffler element assembly 120 that splits the flow of coal/primary air into four outlet flow channels 128. The riffler element assembly 120 of FIG. 16 incorporates a flow control assembly with two stages of wake-inducing airfoils 122, 124 according to an alternative embodiment of the present invention. In the illustrated embodiment, the four-way riffler element assembly 120 includes an inlet flow channel 125 (not shown in FIG. 16, see FIG. 21) for creating flow as shown by directional arrow 126, two intermediate flow channels 127, and four outlet flow channels 128. The two-stage flow control assembly includes a first stage wake-inducing airfoil 122 and two second stage wake-inducing airfoils 124. Each of the three wake-inducing airfoils 122, 124 is adjustable sideways from a 'neutral' position (aligned with the wall of its corresponding channel). All wake-inducing airfoils in each respective stage 122 and 124 may be adjusted in tandem by mounting rods as will be described. The coal/primary air mixture flows through the inlet channel 125 and around the first stage wake-inducing airfoil 122. The element 122 distributes the coal/primary air mixture into the intermediate flow channels 127 where it flows around the second stage wake-inducing airfoils 124. These elements 124 further distribute the mixture into the outlet flow channels 128.

Figure 17:
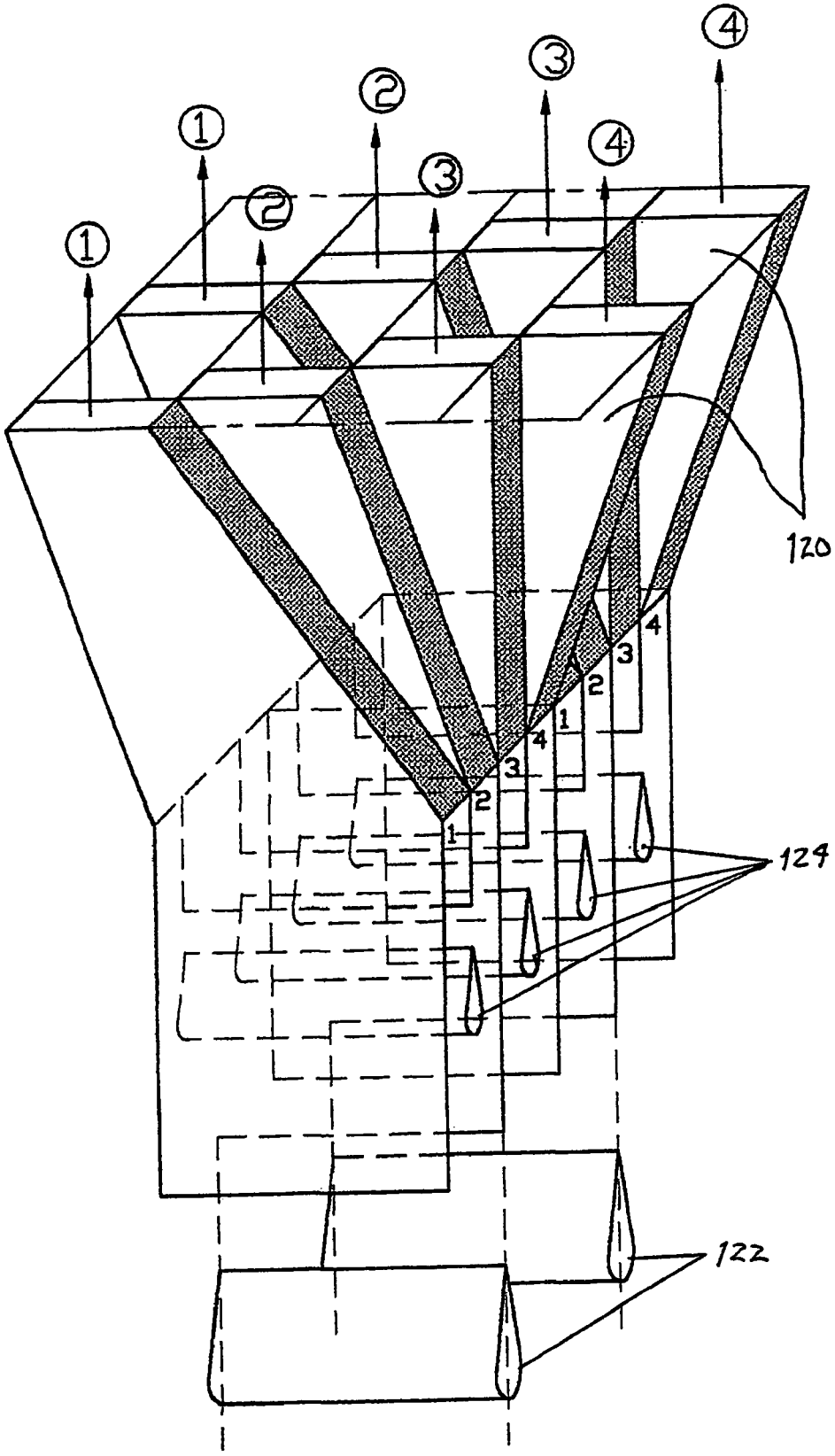
FIG. 17 shows the joining of two, four-way riffler element assemblies 120 to form a sub-section of a complete four-way splitter.

FIG. 17 shows the side-by-side joining of two, four-way riffler element assemblies 120 as in FIG. 16 plus a respective pair of two-stage flow control assemblies both including a first stage wake-inducing airfoil 122 and two second stage wake-inducing airfoils 124, to thereby form a complete four-way splitter.

Figure 18:
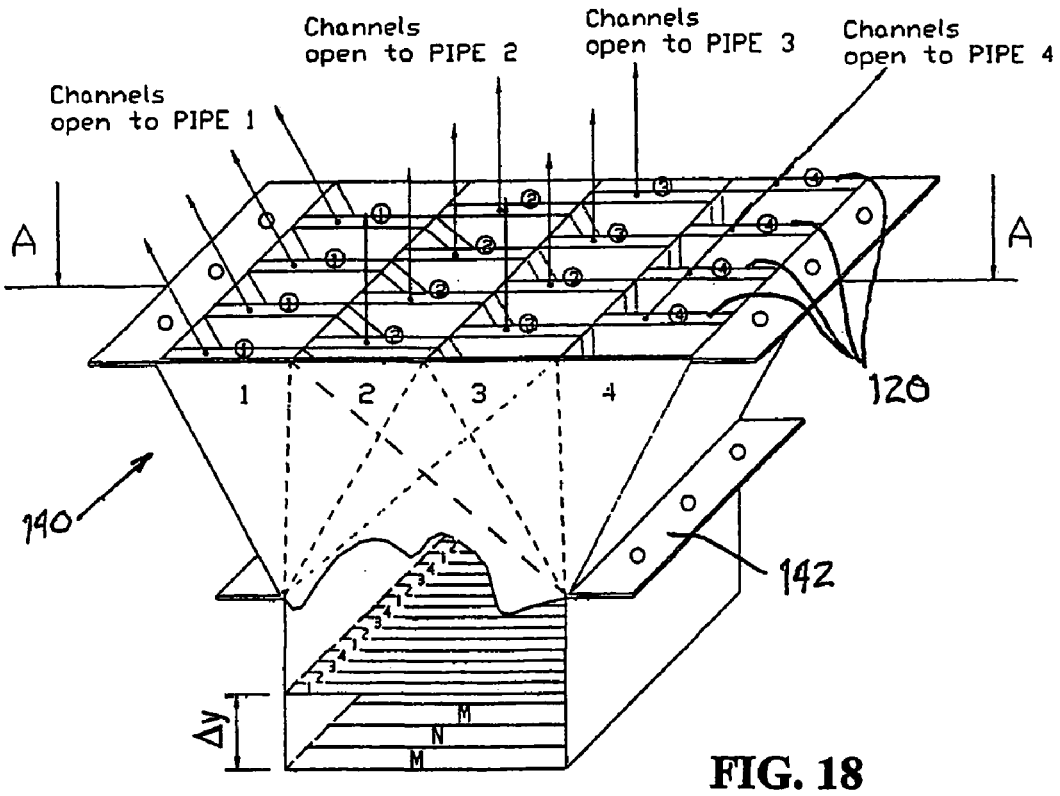
FIGS. 18 and 19 are a perspective view and a top view, respectively, showing a complete four-way splitter 140 with four riffler element assemblies 120 joined as in FIG. 17.
Figure 19:
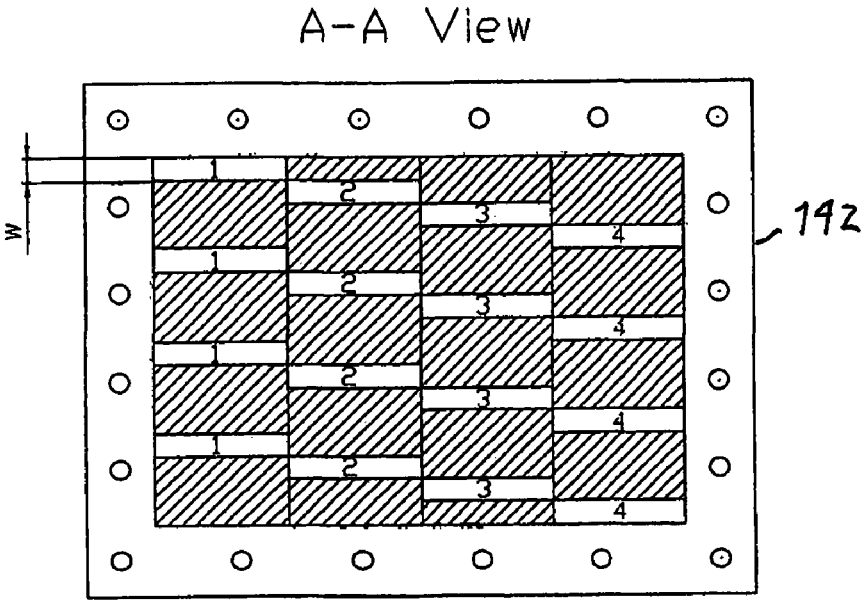

FIGS. 18 and 19 are a perspective view and a top view, respectively, showing a complete four-way splitter 140 including the housing 142 and four riffler element assemblies 120 joined as in FIG. 17.

Figure 20:
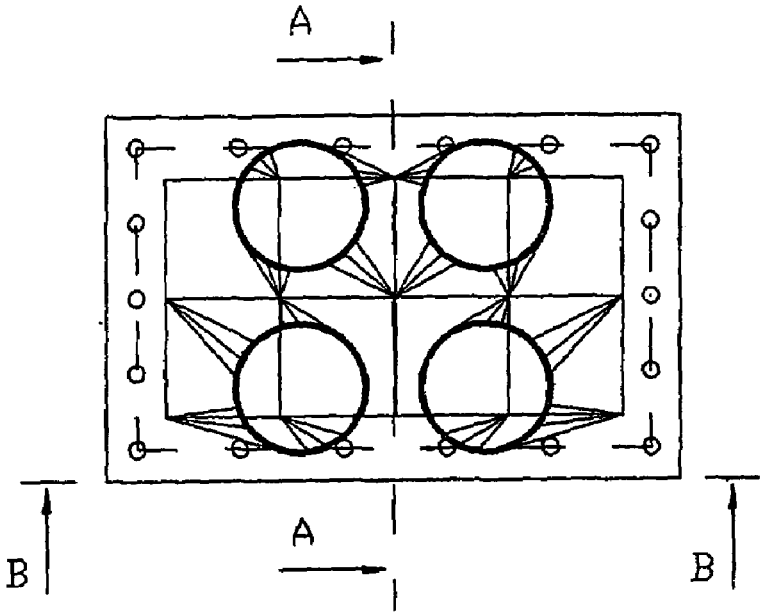
FIGS. 20, 21 and 22 are a top view, side view and front view, respectively, of a square outlet coal pipe arrangement, utilized in pulverized coal boiler systems, that require the use of four-way splitters.
Figure 21:
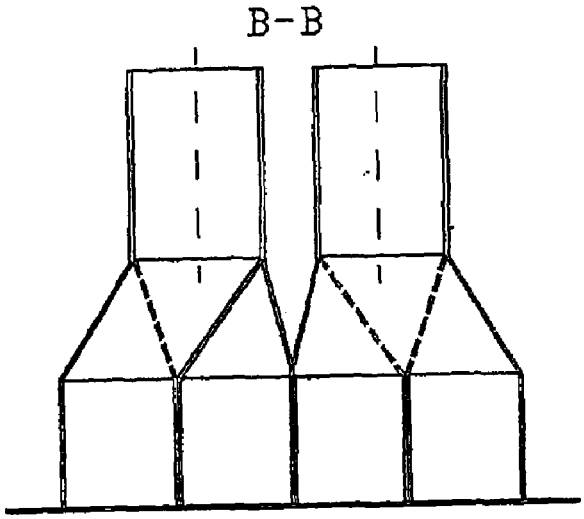
Figure 22:
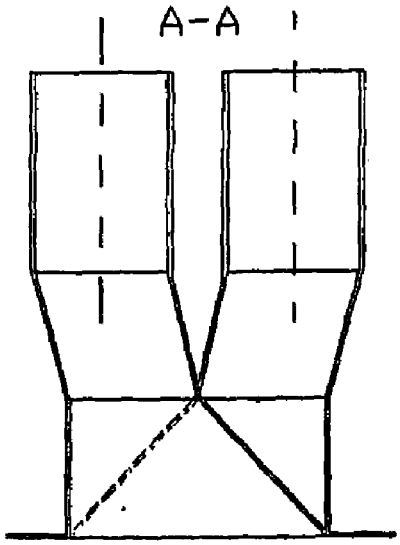
Figure 23:
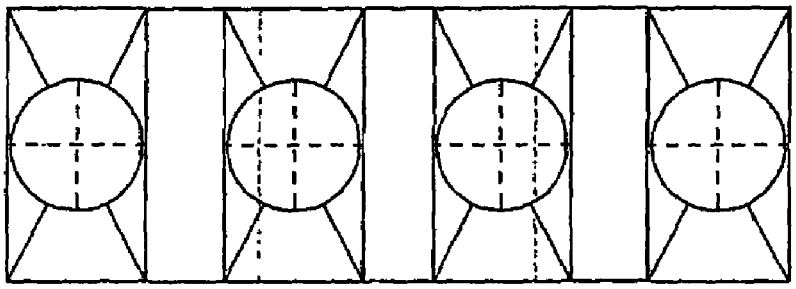
FIGS. 23–26 are a top view, end view, front view, and bottom view of an in-line outlet coal pipe arrangement.
Figure 24:
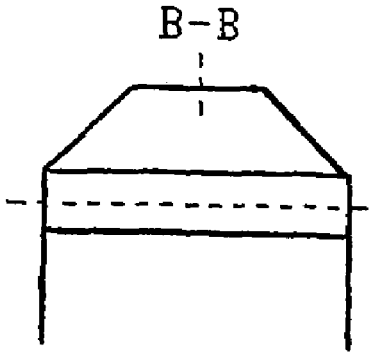
Figure 25:
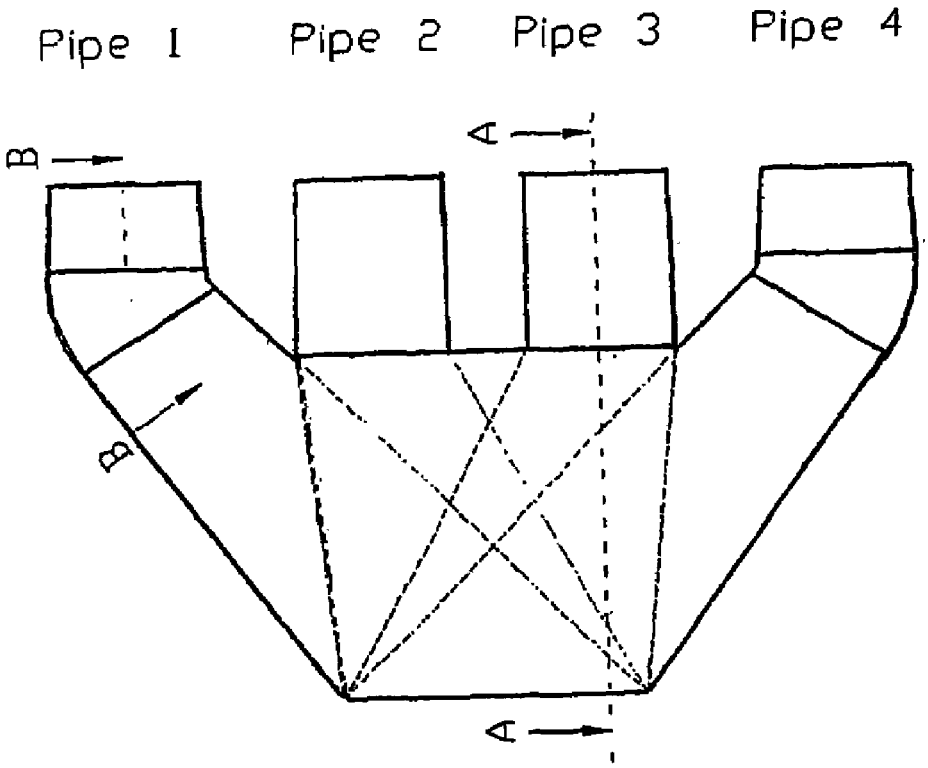
Figure 26:
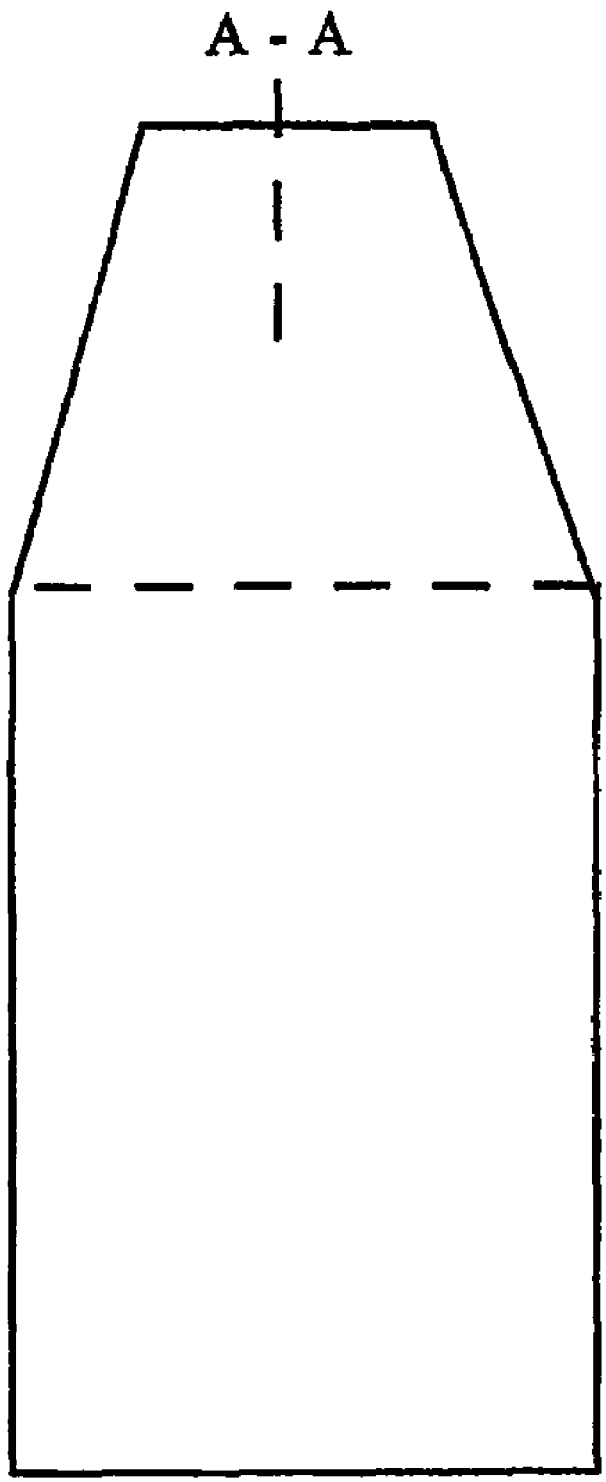

FIGS. 20, 21 and 22 are a top view, side view and front view, respectively, of another example of a square outlet coal pipe arrangement, utilized in pulverized coal boiler systems, that require the use of four-way splitters.

FIGS. 23–26 are a top view, end view, front view, and bottom view of an in-line arrangement. Factors such as the pre-existing layout of the coal/primary air mixture delivery system dictate which of the possible outlet pipe arrangements can be implemented.

Figure 27:
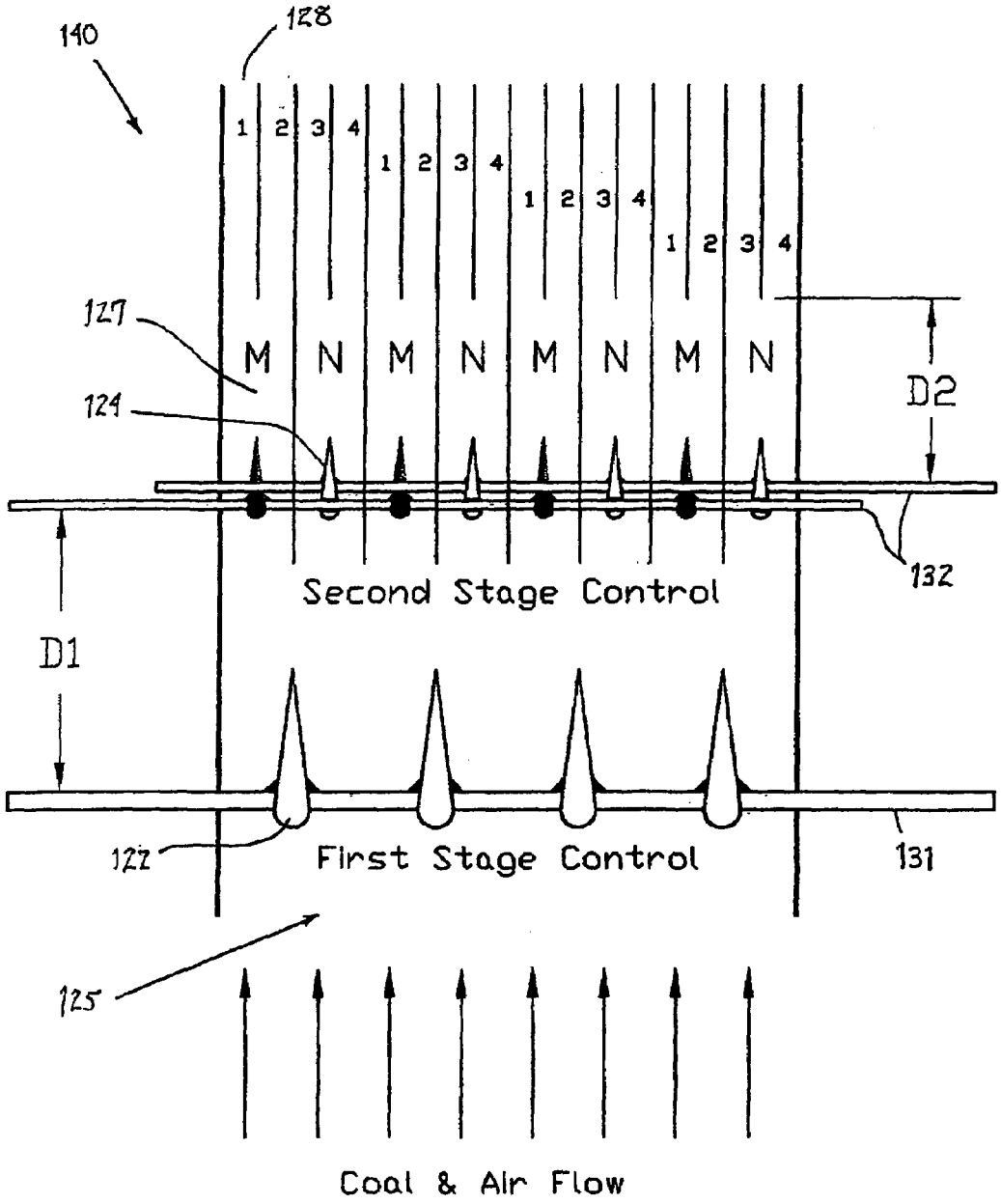
FIG. 27 is an end view perspective of the complete four-way splitter 140, including the first and second stage wake-inducing airfoils 122, 124, according to an alternative embodiment of the present invention.

FIG. 27 shows the relative positions of the first and second stage wake-inducing airfoils 122, 124, respective mounting rods 131, 132 for tandem adjustment, and the inlet, intermediate, and outlet flow channels 125, 127, 128. It can be readily seen how the present invention achieves coal flow control in a two stage process. Flow from the inlet flow channel 125 is passed by the first stage wake-inducing airfoil 122 in order to convert the single flow into two, approximately equal coal flows through the two intermediate flow channels 127. Generally, the two intermediate flows are each then passed by the second stage control elements 124 in order to convert the two intermediate flows into four, approximately equal coal flows, which are in turn directed into each of four discrete channels of a riffler element assembly to accomplish balanced coal flows among all outlet pipes thereof. Moreover, the apparatus for the on-line balancing is simple in construction, contains a small number of individual components, and can be provided as original equipment or designed to readily retrofit a large number of existing pulverized coal boiler systems without excessive modification.

More specifically, the first stage wake-inducing airfoils 122 (attached to mounting rod 131) are for balancing coal flows in the intermediate channels 127 (those designated "M" and "N"). The second stage wake-inducing airfoils 124 (two sets that are independently adjustable via two sets of mounting rods 132) are for balancing coal flows in the outlet pipes 128. The positions of the wake-inducing airfoils 122, 124 with respect to each other (i.e. along the mounting rods 131, 132), and the distance from them to the leading edges of the flow channel walls (shown as dimensions "D1" and "D2") are selected so as not to disturb the primary air flow balance in any of the outlet pipes 128 as the position of the flow controller elements 122, 124 are adjusted by sliding the mounting rods 131, 132 to the left or right (as oriented in FIG. 23).

The mounting rods 131, 132 are accessible during any normal operating cycle of the pulverized coal boiler assembly. This provides for the opportunity to make "on-line" adjustments to the positions of the first and second stage wake-inducing airfoils 122, 124 during normal operation of the boiler system. On-line adjustments allow the operation of the boiler system to be optimized independently of other surrounding conditions.

Referring back to FIG. 9, the preferred cross-section of the wake-inducing airfoils 122, 124 as in FIGS. 17 and 27 is likewise cone-shaped with a convex, rounded leading surface possessing a width "b" that is proportional to the width of the flow channel in which it is positioned. Downstream of the wake-inducing airfoils 122, 124, the coal flow creates a wider wake than that of the primary air flow. In other words, the primary air flow is only slightly affected by the streamlined design of the wake-inducing foils 122, 124. Laboratory tests have demonstrated the effectiveness of the foregoing device in adjusting coal flow distribution without affecting primary air flow distribution. Tests were carried out with a single 6" inlet pipe and four 3¼" outlet pipes. The inlet air velocity was set at 75 feet per second (fps) and the ratio of the primary air mass flow rate to the coal mass flow rate was 1.7. The amount of flow imbalance is defined as the flow rate differential between the measured flow in a pipe and the average flow rate that would create perfectly balanced flow among the four outlet pipes, divided by that same average flow rate. Therefore, the amount of flow imbalance at a four-way splitter can be mathematically expressed as:

$$I_i = \frac{m_i - m_{avg}}{m_{avg}}$$

Where the term $m_i$ represents the measured flow rate in the $i^{th}$ outlet pipe and the term $m_{avg}$ is the average flow rate calculated as follows:

$$m_{avg} = \frac{m_1 + m_2 + m_3 + m_4}{4}$$

Figure 28:
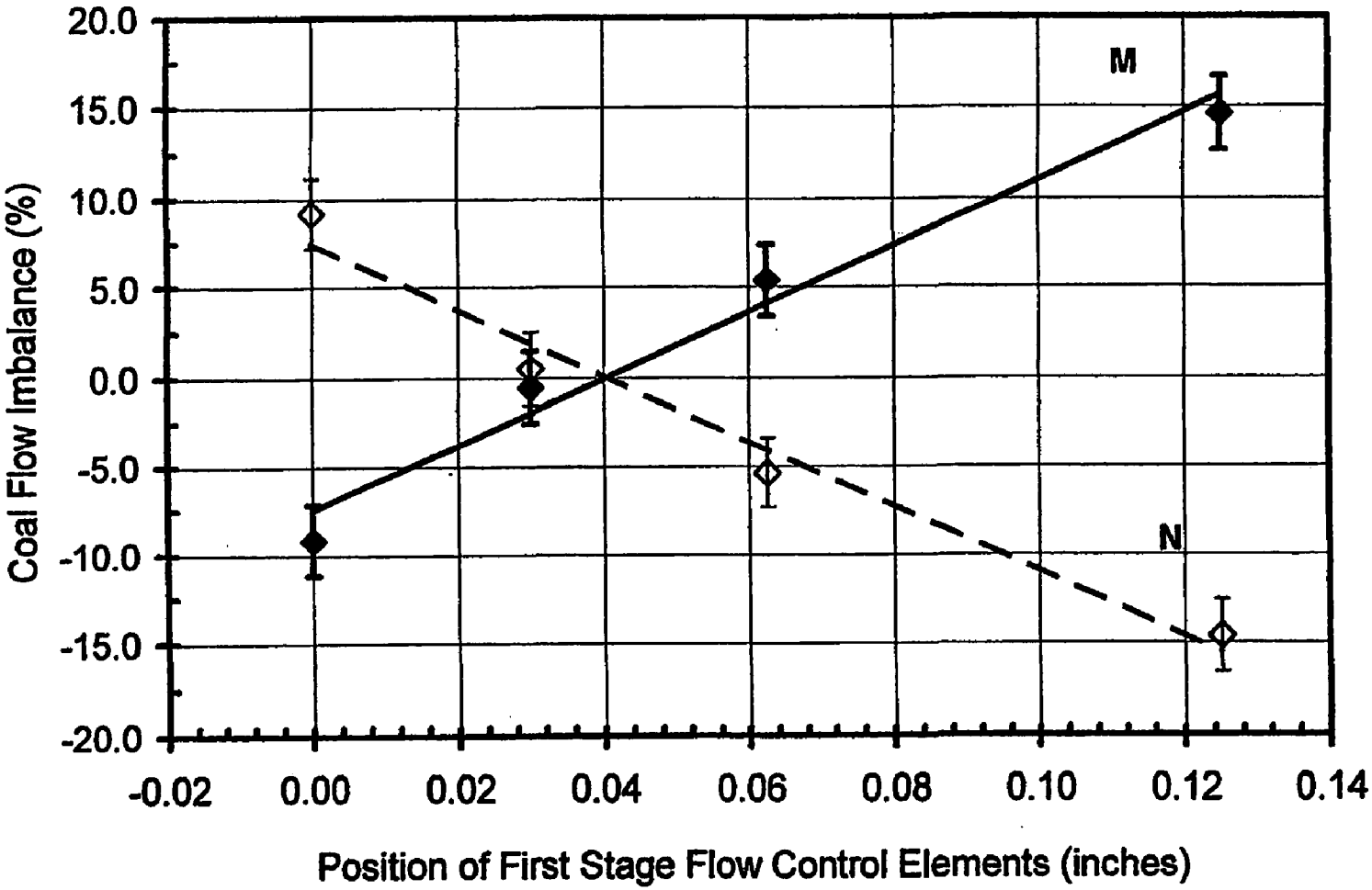
FIG. 28 is a graphical representation of the results of a series of laboratory tests on the effect of the position of the first stage wake-inducing airfoil 122 on the coal flow balance within a four-way splitter 140 designed in accordance with an alternative embodiment of the present invention.

FIG. 28 plots the effect of the position of the first stage wake-inducing airfoils 122 on coal flow balance between the intermediate channels 127 designated (in FIG. 27) with an "M" and those marked with an "N". As the first stage wake-inducing airfoils 122 were moved towards the left (as seen in FIG. 27), less coal flowed to the "M" channels, resulting in negative coal flow imbalances for the "M" channels (as shown by the solid line in FIG. 28). In a similar fashion, as the first stage wake-inducing airfoils 122 were moved towards the right, less coal flowed to the "N" channels, resulting in negative coal flow imbalances for the "N" channels (as shown by the dotted line in FIG. 28). With the wake-inducing airfoils 122 positioned 0.04" to the right of the neutral position shown in FIG. 27, the coal flows to all of the intermediate channels 127 were perfectly balanced.

It should be mentioned that this 0.04" from neutral position for the first stage elements 122 does not guarantee balanced coal flow between the various outlet pipes 128 designated (in FIG. 27) with "1", "2", "3", and "4". To accomplish balanced coal flows among all outlet pipes 128, the second stage wake-inducing foils 124 must also be positioned properly.

Figure 5:
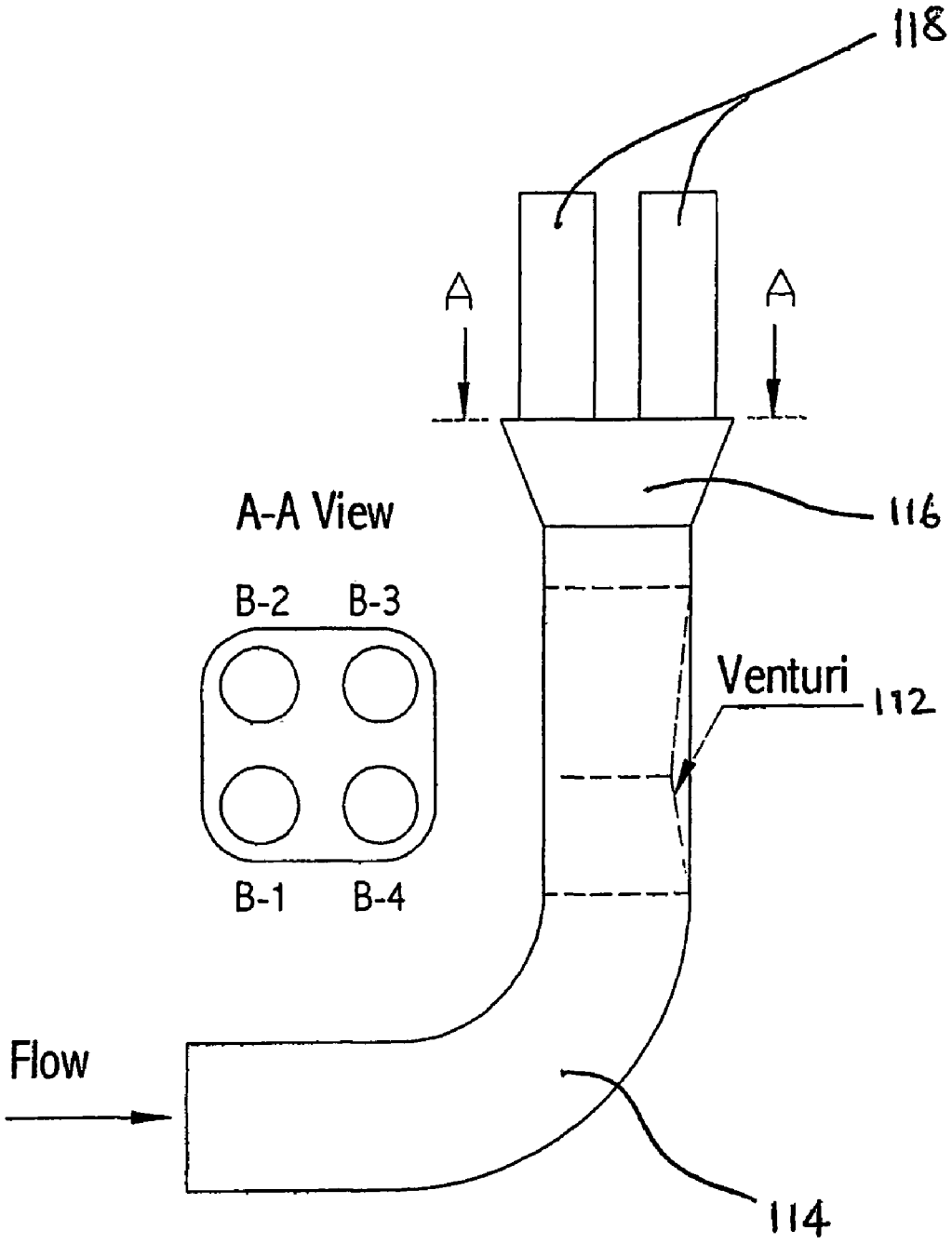
FIG. 5 illustrates a sub-section of a multi-pipe arrangement where a Venturi 112 has been installed.
Figure 29:
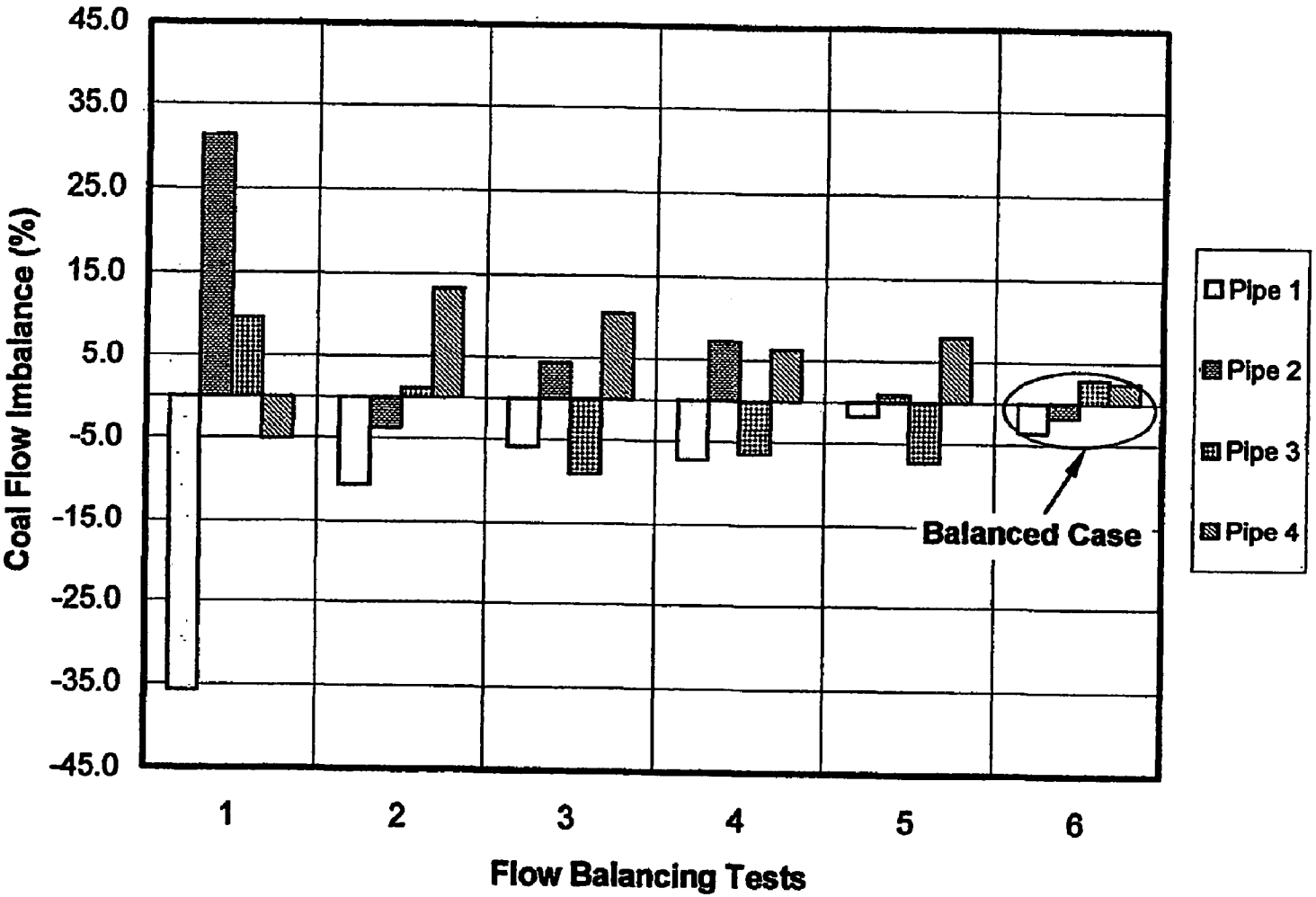
FIG. 29 is a graphical representation of the results of a series of laboratory tests showing the coal flow balancing capability of a four-way splitter 140 designed in accordance with an alternative embodiment of the present invention.

The results of several laboratory trials are illustrated in FIG. 29. Test no. 1 shows the coal flow imbalance for the four outlet pipes using the four-way splitter configuration shown in FIG. 5 (i.e. without four-way riffler element assemblies and wake-inducing foils). Test no. 2 shows the results obtained by using the present invention with the wake-inducing airfoils 122, 124 located at the neutral positions shown in FIG. 27 (i.e. aligned with the walls of the intermediate and outlet flow channels). A comparison of Test nos. 1 and 2 indicates that the coal flow imbalance was reduced from ±35% to ±13% by using the new four-way splitter. A series of changes in the positions of the wake-inducing foils 122, 124 are reflected in the results of Test nos. 3 through 6. Note that Test no. 6 shows nearly perfect coal flow balance among the four outlet pipes, a reduction in coal flow imbalance to less than ±4%.

Figure 30:
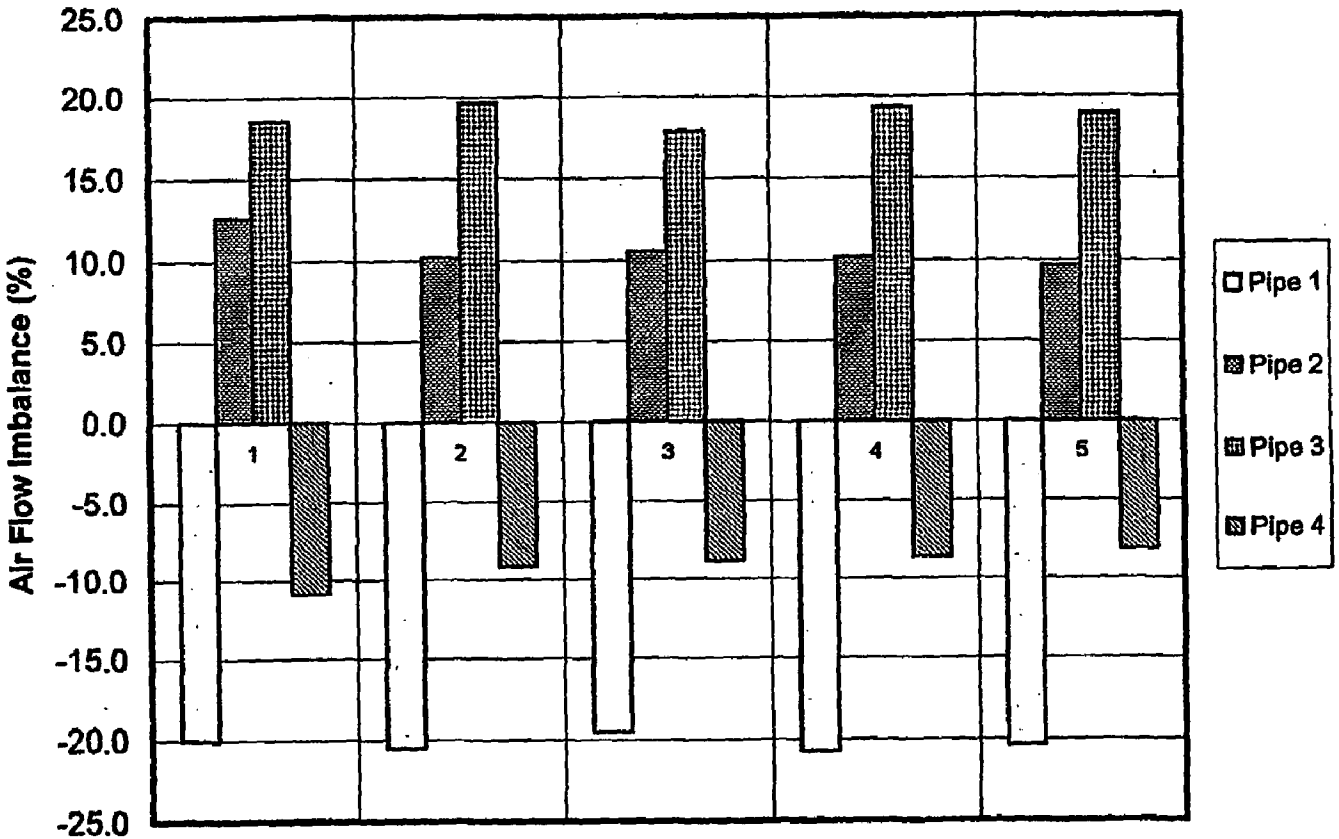
FIG. 30 is a graphical representation of the results of a series of laboratory tests demonstrating the effect of the position of the first and second stage wake-inducing foils 122, 124 on the pre-existing primary air flow balance within a four-way splitter 140 designed in accordance with an alternative embodiment of the present invention.

FIG. 30 plots the primary air flow imbalance present during each of the last five coal flow tests recorded in FIG. 29 (i.e. Test nos. 2 through 6). As is readily apparent from the five sets of data shown in FIG. 30, any change in the positions of the wake-inducing airfoils 122, 124 has only a slight effect on the pre-existing primary air flow imbalance.

It is noteworthy that in some piping arrangements, the coal/primary air flow from a single pipe is split into three, four, five or more outlet streams. It should be understood that the present invention encompasses system configurations in addition to those described above (for two or four outlet pipes), for instance, which combine adjustable wake-inducing airfoils with a slotted riffler utilized to control the distribution of coal flow among three outlet pipes, five outlet pipes or any number of outlet pipes.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. In a slotted plate riffler having a plurality of flow channels for directing coal flow and balancing coal flow rates among a plurality of outlet pipes from a splitter junction in a pulverized coal boiler system, a flow control assembly comprising:

at least one wake-inducing airfoil positioned upstream of a corresponding flow channel in said riffler, said airfoil having a cross-section defined by a width W that varies along its length H and defining an aerodynamic center corresponding to the point of maximum thickness, which induces an airflow that is accelerated over the wake-inducing airfoil and therefore produces a wake for creating upstream turbulence and a particle wake that preferentially diverts said coal flow to one of said plurality of outlet pipes from the splitter junction without affecting primary air flow.

2. The flow control assembly according to claim 1, wherein the cross-section of said wake-inducing airfoil comprises a shape from among the group consisting of substantially teardrop, diamond, oval, triangular, circular, pentagonal, and any polygon geometry.

3. The flow control assembly according to claim 1, wherein said slotted plate riffler further comprising an orifice in each of said plurality of outlet pipes for balancing primary air flow rates.

4. The flow control assembly according to claim 1, wherein said at least one wake-inducing airfoil positioned upstream of a corresponding flow channel in said riffler comprises a plurality of wake-inducing airfoils.

5. The flow control assembly according to claim 4, wherein each of said plurality of wake inducing airfoils further comprise a streamlined shape including a rounded convex edge leading to straight tapered sides.

6. The flow control assembly according to claim 5, wherein the straight tapered sides of said plurality of wake inducing foils further comprise a roughened surface for promoting turbulent boundary layers.

* * * * *